US008985745B2

(12) United States Patent
Koseki

(10) Patent No.: US 8,985,745 B2
(45) Date of Patent: Mar. 24, 2015

(54) LIQUID JET HEAD, LIQUID JET APPARATUS, AND METHOD OF MANUFACTURING LIQUID JET HEAD

(71) Applicant: SII Printek Inc., Chiba (JP)

(72) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 8 days.

(21) Appl. No.: 13/719,436

(22) Filed: Dec. 19, 2012

(65) Prior Publication Data

US 2013/0182043 A1 Jul. 18, 2013

(30) Foreign Application Priority Data

Dec. 21, 2011 (JP) ..... 2011-280115

(51) Int. Cl.
*B41J 2/045* (2006.01)
*B41J 2/16* (2006.01)
*B41J 2/14* (2006.01)

(52) U.S. Cl.
CPC ..... *B41J 2/1607* (2013.01); *B41J 2/14209* (2013.01); *B41J 2/1609* (2013.01); *B41J 2/1623* (2013.01); *B41J 2/1632* (2013.01); *B41J 2/14201* (2013.01); *B41J 2/1631* (2013.01); *B41J 2002/14491* (2013.01)
USPC ..... 347/68; 347/72

(58) Field of Classification Search
USPC ..... 347/65, 68–72
See application file for complete search history.

(56) References Cited

U.S. PATENT DOCUMENTS

| | | | | |
|---|---|---|---|---|
| 5,548,894 | A * | 8/1996 | Muto | 29/890.1 |
| 6,959,471 | B2 * | 11/2005 | Temple et al. | 29/25.35 |
| 7,891,782 | B2 * | 2/2011 | Owaki et al. | 347/68 |
| 2007/0070125 | A1 * | 3/2007 | Watanabe | 347/58 |
| 2007/0188564 | A1 | 8/2007 | Harvey et al. | 347/85 |
| 2008/0036823 | A1 | 2/2008 | Tanuma | 347/70 |
| 2009/0284569 | A1 | 11/2009 | Kawaguchi et al. | 347/68 |
| 2010/0238237 | A1 * | 9/2010 | Seki | 347/71 |
| 2011/0102519 | A1 * | 5/2011 | Koseki | 347/71 |
| 2011/0242223 | A1 | 10/2011 | Koseki | 347/50 |

FOREIGN PATENT DOCUMENTS

| | | |
|---|---|---|
| EP | 2363291 | 9/2011 |
| GB | 2362609 | 11/2001 |

(Continued)

OTHER PUBLICATIONS

British IPO Search Report mailed Apr. 22, 2013 issued in GB Appln. No. GB1223299.7.

*Primary Examiner* — Stephen Meier
*Assistant Examiner* — Renee I Wilson
(74) *Attorney, Agent, or Firm* — Adams & Wilks

(57) ABSTRACT

A liquid jet head includes an actuator portion having a first recessed portion, a second recessed portion, sidewalls made of a piezoelectric material and forming grooves provided between and communicating with respective ones of the first and second recessed portions, drive electrodes provided on respective ones of the sidewalls, and electrode terminals for transmitting a drive signal to respective ones of the drive electrodes. A cover plate has a first liquid chamber communicating with the first recessed portion for supplying liquid to the grooves and having a second liquid chamber communicating with the second recessed portion for discharging liquid from the grooves. A nozzle plate has nozzles communicating with respective ones of the grooves for ejecting liquid supplied to the grooves due to deformation of the sidewalls upon transmission of a drive signal by the electrode terminals to respective ones of the drive electrodes.

14 Claims, 13 Drawing Sheets

(56) References Cited

FOREIGN PATENT DOCUMENTS

| | | |
|---|---|---|
| JP | 4658324 | 9/2002 |
| JP | 4263742 | 6/2007 |
| JP | 2009196122 | 9/2009 |
| WO | 0029217 | 5/2000 |
| WO | 2005007415 | 1/2005 |

* cited by examiner

LIQUID JET HEAD, LIQUID JET APPARATUS, AND METHOD OF MANUFACTURING LIQUID JET HEAD

BACKGROUND OF THE INVENTION

1. Field of the Invention

The present invention relates to a liquid jet head for ejecting liquid from a nozzle to record graphics and characters on a recording medium, or to form a functional thin film thereon. The present invention relates also to a liquid jet apparatus using the liquid jet head, and to a method of manufacturing a liquid jet head.

2. Description of the Related Art

In recent years, there has been used an ink-jet type liquid jet head for ejecting ink droplets on recording paper or the like to record characters or graphics thereon, or for ejecting a liquid material on a surface of an element substrate to form a functional thin film thereon. In such a liquid jet head, ink or a liquid material is supplied from a liquid tank via a supply tube to the liquid jet head, and ink or a liquid material filled into a channel is ejected from a nozzle which communicates with the channel. When ink is ejected, the liquid jet head or a recording medium on which a pattern of jetted liquid is to be recorded is moved to record characters or graphics, or to form a functional thin film in a predetermined shape.

Japanese Patent Application Laid-open No. 2009-196122 describes an ink jet head 60 in which ink channels which are a large number of grooves are formed in a sheet formed of a piezoelectric material. FIG. 19 is a sectional view of the ink jet head 60 illustrated in FIG. 2 of Japanese Patent Application Laid-open No. 2009-196122. The ink jet head 60 has a laminated structure of a substrate 62, a piezoelectric member 65, and a cover member 64. Supply ports 81 are formed in the middle of the substrate 62 and discharge ports 82 are formed so as to sandwich the supply ports 81. The piezoelectric member 65 and a frame member 63 are adhered to a front surface of the substrate 62, and the cover member 64 is adhered to an upper surface thereof.

The piezoelectric member 65 is formed by adhering together two piezoelectric plates 73 in which the directions of polarization are opposite to each other. A plurality of minute grooves which extend in a sub-scanning direction (in a direction in parallel with the drawing sheet) are formed by grinding in the piezoelectric member 65, and a plurality of pressure chambers 74 which are arranged at regular intervals in a main scanning direction (in a direction perpendicular to the drawing sheet) are formed. Each of the pressure chambers 74 (channels) is defined by a pair of adjacent walls 75. An electrode 76 is formed continuously on opposing side surfaces of the pair of walls 75 and a bottom portion therebetween, and further, is electrically connected to ICs 66 via electric wiring 77 formed on the front surface of the substrate 62. The cover member 64 is formed by adhering a film 92 and a reinforcing member 94 together via an adhesive. The cover member 64 is adhered to the piezoelectric member 65 and the frame member 63 under a state in which the reinforcing member 94 is on the piezoelectric member 65 side. Openings 96 and nozzles 72 which correspond to the pressure chambers 74 are formed in the reinforcing member 94 and in the film 92, respectively.

Ink is supplied from the supply ports 81 in the middle of the substrate 62, and flows to the plurality of pressure chambers 74 and then to an ink chamber 90 to be discharged from the discharge ports 82. When a drive pulse is applied from the ICs 66 via the electric wiring 77 to the electrode 76 on the pair of walls 75 sandwiching the pressure chamber 74, the pair of walls 75 undergo shear deformation and bend so as to be spaced away from each other, and then return to their initial positions to increase the pressure in the pressure chamber 74. Thus, an ink droplet is ejected from the corresponding nozzle 72.

In this case, each piezoelectric member 65 has a trapezoidal shape. An electrode is formed on an inclined surface of the trapezoidal shape, and the electrode on the inclined surface electrically connects the electric wiring 77 formed on the front surface of the substrate 62 and the electrode 76 formed on the side surface of the piezoelectric member 65. Further, a plurality of the supply ports 81 for ink supply and a plurality of the discharge ports 82 for ink discharge are formed in the substrate 62. Therefore, the electric wiring 77 is formed on the front surface of the substrate 62 in a route that can skirt those supply ports 81 and discharge ports 82. Japanese Patent Nos. 4658324 and 4263742 also describe ink jet heads having substantially similar structures.

In the ink jet head 60 described in Japanese Patent Application Laid-open No. 2009-196122, the piezoelectric member 65 adhered on the front surface of the substrate 62 needs to be subjected to ramping to form the trapezoidal shape. Further, it is necessary to form conductive films on the inclined surface of the trapezoidal shape, both the side surfaces of the piezoelectric members 65, and the front surface of the substrate 62. Then, it is necessary to electrically separate the conductive films on both the side surfaces to form the electrodes 76, and pattern the conductive film on the substrate 62 to form a large number of electric wirings 77. However, the piezoelectric members 65 are adhered onto the front surface of the substrate 62, and hence a large number of protrusions are present. Further, the conductive film to be processed is inclined. Therefore, a minute process by photolithography and etching is difficult. In Japanese Patent Application Laid-open No. 2009-196122, the electric wirings 77 are formed one by one by laser patterning, and the conductive film on the inclined surface of the piezoelectric member 65 is electrically separated for every inclined surface. Thus, the electrode is processed by a linear process, and hence positioning and the like are complicated and a long period of time is required. Further, the frame member 63 is provided after the electric wirings 77 are formed on the substrate 62, and hence manufacturing steps including positioning, adhering, and processing of the frame member 63, and planarizing of a front surface 94*a* of the frame member 63 and a front surface of the trapezoidal piezoelectric member 65 become extremely complicated.

Further, in the ink jet head 60 of Japanese Patent Application Laid-open No. 2009-196122, the electric wiring 77 is formed on the substrate 62 on a front surface 92*a* side which is the ink ejection side, and the IC 66 is mounted on the same side. The cover member 64 comes close to the recording medium, and hence the height of the IC 66 is limited. Further, the IC 66 and a control circuit (not shown) need to be electrically connected to each other by a flexible substrate or the like, but the height thereof is limited also in this case.

SUMMARY OF THE INVENTION

The present invention has been made in view of the above-mentioned problems, and has an object to provide a liquid jet head in which an electrode pattern can be easily processed, and the limitation on the height of an electrical connection portion with respect to a control circuit or the like is alleviated.

According to an exemplary embodiment of the present invention, there is provided a liquid jet head, including: an actuator portion including: a first recessed portion; a second recessed portion formed at a distance from the first recessed portion; a channel row provided between the first recessed portion and the second recessed portion, the channel row including a plurality of channels arrayed therein, the plurality of channels each having one end portion opened to the first recessed portion and another end portion opened to the second recessed portion; and an electrode terminal row provided on a front surface on an outer peripheral side with respect to one of the second recessed portion and the first recessed portion, the electrode terminal row including a plurality of electrode terminals for transmitting a drive signal to the channel row; a cover plate including a first liquid chamber communicated with the first recessed portion and a second liquid chamber communicated with the second recessed portion, the cover plate being bonded to the actuator portion while exposing the electrode terminal row and covering the channel row; and a nozzle plate including a nozzle row which is formed of a row of nozzles communicated with the plurality of channels, the nozzle plate being bonded to the actuator portion on a side opposite to the cover plate.

Further, the second recessed portion includes a right second recessed portion and a left second recessed portion which are provided so that the first recessed portion is interposed therebetween. The channel row includes: a left channel row provided between the left second recessed portion and the first recessed portion; and a right channel row provided between the right second recessed portion and the first recessed portion. The electrode terminal row includes: a left electrode terminal row provided on a front surface on an outer peripheral side with respect to the left second recessed portion, for supplying the drive signal to the left channel row; and a right electrode terminal row provided on a front surface on an outer peripheral side with respect to the right second recessed portion, for supplying the drive signal to the right channel row. The nozzle row includes: a left nozzle row communicated with channels in the left channel row; and a right nozzle row communicated with channels in the right channel row.

Further, the left nozzle row and the right nozzle row are shifted by ½ of a channel pitch from each other in a row direction.

Further, the plurality of channels are formed of a plurality of grooves, respectively, which are each sandwiched by two walls of a plurality of walls extending from the first recessed portion to the second recessed portion. The channel row is formed of an array of the plurality of grooves defined by the plurality of walls. Each of the plurality of walls has a side surface on which a drive electrode is provided.

Further, corresponding one of the plurality of electrode terminals and the drive electrode are electrically connected to each other via a wiring electrode formed on a bottom portion of the one of the second recessed portion and the first recessed portion.

Further, the one of the second recessed portion and the first recessed portion has a bottom surface including a protrusion, which is continuous with corresponding one of the plurality of walls and which remains when an upper part of the corresponding one of the plurality of walls is removed. The wiring electrode is formed on a side surface of the protrusion and the bottom surface between adjacent protrusions.

Further, the plurality of grooves are extended to reach an outer peripheral end side of the actuator portion with respect to at least one of the second recessed portion and the first recessed portion.

Further, the liquid jet head further includes a flexible substrate bonded to the front surface of the actuator portion on an end portion side and electrically connected to the electrode terminal row.

Further, the actuator portion has a laminated structure in which a piezoelectric material upwardly-polarized with respect to the front surface and a piezoelectric material downwardly-polarized with respect to the front surface are laminated.

Further, the actuator portion is made of a piezoelectric material in a part between the first recessed portion and the second recessed portion, and made of an insulating material having a dielectric constant smaller than a dielectric constant of the piezoelectric material in a part on an outer peripheral side with respect to one of the second recessed portion and the first recessed portion.

Further, the plurality of channels are communicated with the nozzles via through holes, respectively.

Further, the actuator portion includes a base plate, and the through holes are formed in the base plate.

According to an exemplary embodiment of the present invention, there is provided a liquid jet apparatus, including: the above-mentioned liquid jet head; a moving mechanism for reciprocating the liquid jet head; a liquid supply tube for supplying liquid to the liquid jet head; and a liquid tank for supplying the liquid to the liquid supply tube.

According to an exemplary embodiment of the present invention, there is provided a method of manufacturing a liquid jet head, including: a through hole forming step of forming through holes in a base plate; an actuator portion forming step of forming an actuator portion made of a piezoelectric material; a bonding step of bonding the actuator portion to the base plate; a groove forming step of forming a plurality of grooves and a plurality of walls defining the plurality of the grooves, which are arranged in parallel, on a side of the actuator portion opposite to the base plate, thereby forming a channel row formed of the plurality of grooves which are arranged in parallel; a conductive film forming step of depositing a conductive material on the actuator portion, thereby forming a conductive film on upper surfaces and side surfaces of the plurality of walls and bottom surfaces of the plurality of grooves; a recessed portion forming step of grinding the plurality of walls in a direction intersecting with a longitudinal direction of the plurality of grooves, thereby forming a first recessed portion and a second recessed portion which are distanced from each other via the channel row and communicated with the plurality of grooves; an electrode forming step of patterning the conductive film, thereby forming drive electrodes on the side surfaces of the plurality of walls and forming electrode terminals of a front surface of the actuator portion; a cover plate bonding step of bonding, to the actuator portion, a cover plate including a first liquid chamber and a second liquid chamber under a state in which the first liquid chamber and the second liquid chamber are communicated with the first recessed portion and the second recessed portion, respectively, the electrode terminals are exposed, and upper openings of the plurality of grooves are closed; a grinding step of grinding the base plate on a side opposite to the actuator portion; and a nozzle plate bonding step of bonding a nozzle plate to the base plate.

Further, the groove forming step includes forming the channel row including a left channel row and a right channel row which are distanced from each other. The recessed portion forming step includes forming the first recessed portion between the left channel row and the right channel row, and forming the second recessed portion including a left second recessed portion and a right second recessed portion on an outer side of the left channel row and the right channel row with respect to the first recessed portion, respectively.

Further, the groove forming step includes forming the plurality of grooves so that the left channel row and the right channel row are shifted by ½ of a channel pitch from each other in a row direction.

Further, the recessed portion forming step includes performing grinding to reach a bottom surface of each of the plurality of grooves when the first recessed portion is formed, and performing grinding of upper portions of the plurality of walls so as to leave the bottom surface of the each of the plurality of grooves when the left second recessed portion and the right second recessed portion are formed.

Further, the actuator portion forming step includes laminating and bonding a piezoelectric material upwardly-polarized with respect to a substrate surface and a piezoelectric material downwardly-polarized with respect to the substrate surface.

Further, the actuator portion forming step includes forming the actuator portion by fitting a piezoelectric substrate made of the piezoelectric material in a region of an insulating substrate made of an insulating material having a dielectric constant smaller than a dielectric constant of the piezoelectric material, the region becoming the channel row.

Further, the method of manufacturing a liquid jet head further includes, prior to the groove forming step, a photosensitive resin film providing step of providing a photosensitive resin film on a surface of the actuator portion on a side opposite to the base plate. The electrode forming step includes patterning of the conductive film by a lift off method of removing the photosensitive resin film.

Further, the groove forming step includes forming the plurality of grooves to have a depth reaching the base plate.

Further, the groove forming step includes forming the plurality of grooves so as to extend to reach an outer peripheral end side of the actuator portion with respect to at least one of the first recessed portion and the second recessed portion.

Further, the method of manufacturing a liquid jet head further includes a flexible substrate bonding step of bonding a flexible substrate on the front surface of the actuator portion, thereby electrically connecting wiring electrodes formed on the flexible substrate and the electrode terminals.

According to the present invention, the liquid jet head includes: the actuator portion including: the first recessed portion; the second recessed portion formed at a distance from the first recessed portion; the channel row provided between the first recessed portion and the second recessed portion, the channel row including the plurality of channels arrayed therein, the plurality of channels each having the one end portion opened to the first recessed portion and the another end portion opened to the second recessed portion; and the electrode terminal row provided on the front surface on the outer peripheral side with respect to the one of the second recessed portion and the first recessed portion, the electrode terminal row including the plurality of electrode terminals for transmitting the drive signal to the channel row; the cover plate including the first liquid chamber communicated with the first recessed portion and the second liquid chamber communicated with the second recessed portion, the cover plate being bonded to the actuator portion while exposing the electrode terminal row and covering the channel row; and the nozzle plate including the nozzle row which is formed of the row of nozzles communicated with the plurality of channels, the nozzle plate being bonded to the actuator portion on the side opposite to the cover plate. With this, the electrode terminals are provided on the side opposite to the liquid ejection surface, and hence it is unnecessary to provide a limitation on the height for connection with respect to an outside circuit. Further, the wiring electrodes can be formed by collective patterning, and hence the manufacturing method is facilitated.

DETAILED DESCRIPTION OF THE PREFERRED EMBODIMENTS

Liquid Jet Head

First Embodiment

Figure 1:
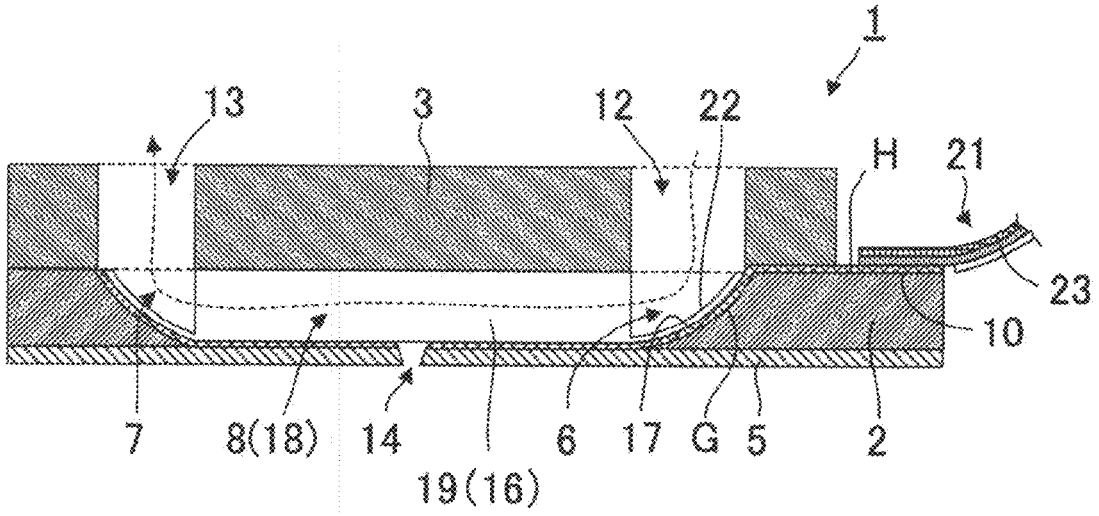
FIG. 1 is a schematic vertical sectional view of a liquid jet head according to a first embodiment of the present invention taken along a longitudinal direction of a channel.

FIG. 1 is a schematic vertical sectional view of a liquid jet head 1 according to a first embodiment of the present invention taken along a longitudinal direction of a channel 8. As illustrated in FIG. 1, the liquid jet head 1 includes an actuator portion 2 having the channels 8 for liquid droplet ejection formed therein, a cover plate 3 for closing openings on one side of the channels 8, and a nozzle plate 5 for liquid droplet ejection, which is bonded to the actuator portion 2 and closes the other side of the channels 8.

The actuator portion 2 includes a first recessed portion 6, a second recessed portion 7 formed at a distance from the first recessed portion 6, a channel row (not shown), and an electrode terminal row (not shown). The channel row is provided between the first recessed portion 6 and the second recessed portion 7, and includes the plurality of channels 8 each having one end portion opened to the first recessed portion 6 and the other end portion opened to the second recessed portion 7, the plurality of channels 8 being arrayed toward the back side of the drawing sheet. The electrode terminal row is provided on a front surface H on an outer peripheral side with respect to the first recessed portion 6, and includes a plurality of electrode terminals 10 for transmitting a drive signal to the channel row, the plurality of electrode terminals 10 being arrayed toward the back side of the drawing sheet.

The actuator portion 2 may be made with use of a piezoelectric material subjected to polarization processing. Examples of the piezoelectric material to be used include lead zirconate titanate (PZT) ceramics. The actuator portion 2 may have a laminated structure in which a piezoelectric material polarized in an upward direction with respect to the front surface H (normal direction of the front surface H) and a piezoelectric material polarized in a downward direction with respect to the front surface H (direction opposite to the normal direction) are laminated. The channel 8 is formed of a groove 18 which is sandwiched by two walls 19 extending from the first recessed portion 6 to the second recessed portion 7. The channel row is formed of an array of the plurality of grooves 18 defined by the plurality of walls 19. A drive electrode 16 is provided on a side surface of each of the walls 19 forming the channels 8. The first recessed portion 6 and the second recessed portion 7 are each formed of a region obtained by removing the plurality of walls 19 while leaving protrusions 22 unremoved, which are parts of the plurality of walls 19. Therefore, a side surface of the protrusion 22 and the side surface of the wall 19 are continuous with each other. Further, each of the channels 8 is opened to the first recessed portion 6 and the second recessed portion 7.

The cover plate 3 includes a first liquid chamber 12 communicated with the first recessed portion 6 and a second liquid chamber 13 communicated with the second recessed portion 7. The cover plate 3 is bonded to the front surface H of the actuator portion 2 while exposing the electrode terminal row including the electrode terminals 10 arrayed toward the back side of the drawing sheet and covering the channel row including the channels 8 arrayed toward the back side of the drawing sheet. It is preferred that the cover plate 3 have a coefficient of thermal expansion which is nearly equal to that of the actuator portion 2. For example, the cover plate 3 may be made with use of the same piezoelectric material as the actuator portion 2.

The nozzle plate 5 includes a nozzle row (not shown) which is formed of a row of nozzles 14 communicated with the channels 8 and arrayed toward the back side of the drawing sheet. The nozzle plate 5 is bonded to the actuator portion 2. The nozzle plate 5 forms a bottom portion of each groove 18, and a wiring electrode 17 is extended on a front surface of the bottom portion on the channel 8 side. As the nozzle plate 5, a polyimide film may be used. Alternatively, a ceramic material, a glass material, or other inorganic materials, which have rigidity higher than that of the polyimide film, may be used. On the front surface H of the actuator portion 2 on the outer peripheral end side, a flexible substrate 21 is provided. A wiring electrode 23 formed on the flexible substrate 21, and the electrode terminal 10 are electrically connected to each other via an anisotropic conductive member (not shown).

The electrode terminal 10 and the drive electrode 16 are electrically connected to each other via the wiring electrode 17 formed on a bottom surface G of the first recessed portion 6. That is, the bottom surface G of the first recessed portion 6 includes the protrusion 22 that is continuous with the wall 19 and that remains when the upper part of the wall 19 is removed. The wiring electrode 17 is formed on the side surface of the protrusion 22 and on the bottom surface G between the adjacent protrusions 22. Therefore, the drive signal applied to the electrode terminal 10 is transmitted to the drive electrode 16 via the wiring electrode 17.

The liquid jet head 1 is driven as follows. Liquid is supplied from a liquid tank (not shown) to the first liquid chamber 12 of the cover plate 3. Then, the liquid flows into the first recessed portion 6, and flows out from the first recessed portion 6 to fill each of the channels 8. Then, the liquid flows out from the second recessed portion 7 to the second liquid chamber 13, and returns to the liquid tank (not shown). Next, when the drive signal is applied from a control circuit (not shown) to the electrode terminal 10, the drive signal is transmitted to the drive electrode 16 on the side surface of the wall 19 forming the corresponding channel 8 via the wiring electrode 17. When an electric field is applied to the wall 19 based on the drive signal, the wall 19 deforms in a shearing mode, and the wall 19 is bent and deformed to change the volume of the channel 8. Thus, the liquid filled inside the channel 8 is ejected as a liquid droplet via the nozzle 14. The liquid jet head 1 performs ejection operation by, for example, three-cycle driving in which three channels are provided as one set and the respective channels are sequentially selected.

As described above, an electrode terminal row 11 is provided on the front surface H of the actuator portion 2 on the side opposite to the side on which the liquid droplets are ejected. Therefore, there is no need to provide limitation on height for connection to the outside circuit, and limitation on thickness of the flexible substrate 21 and other elements, which are provided on the electrode terminal row 11, is significantly alleviated. Further, the electrode terminal 10 can be formed on the front surface H of the actuator portion 2 by collective patterning. Further, the liquid jet head 1 is a circulation-type liquid jet head in which liquid circulates. Therefore, by driving the actuator portion 2, generated heat is transmitted to the liquid, which enables efficient heat dissipation. Further, air bubbles and dust, which are mixed into the liquid, can be rapidly discharged to the outside. Thus, the liquid is not wasted, and it is also possible to suppress wasteful consumption of the recording medium due to recording failure.

Further, no high-dielectric constant piezoelectric material is present at the bottom portion of the groove 18, and hence a cross talk in which the drive signal leaks between the adjacent channels 8 is reduced. Further, a large part of the wall 19 is removed in the first and second recessed portions 6 and 7, and hence, as compared to the case where the wall 19 is present in this region and the drive electrodes are formed on both side surfaces of the wall 19, power consumption is significantly reduced.

Note that, in the above-mentioned embodiment, a piezoelectric material which is subjected to polarization processing is used as the actuator portion 2, but instead, only the wall 19 forming the channel 8 may be made of a piezoelectric material, and the first recessed portion 6, the second recessed portion 7, and parts on the outer peripheral side with respect to the first recessed portion 6 and the second recessed portion 7 may be made of an insulating material having a dielectric constant smaller than that of the piezoelectric material. With this configuration, it is possible to reduce the usage amount of the expensive piezoelectric material and reduce the manufacturing cost. Further, the wiring electrode and the electrode terminal row are not formed on the piezoelectric material, and hence the capacitance between the electrodes is reduced, and thus power consumption is significantly reduced. Note that, as the insulating material, a low-dielectric constant material such as machinable ceramics, alumina ceramics, and silicon dioxide may be used.

Second Embodiment

Figure 2:
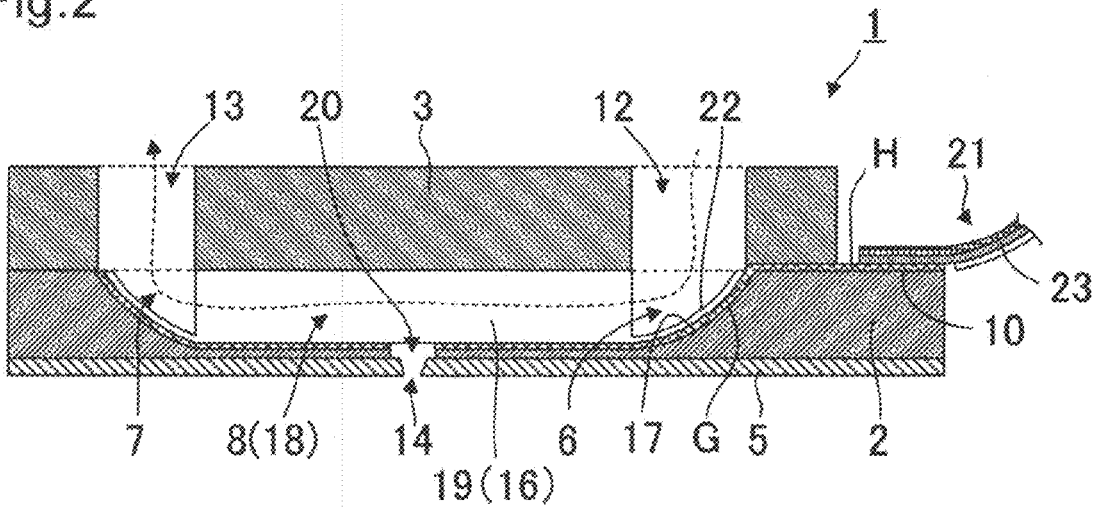
FIG. 2 is a schematic vertical sectional view of a liquid jet head according to a second embodiment of the present invention taken along a longitudinal direction of a channel.

FIG. 2 is a schematic vertical sectional view of a liquid jet head 1 according to a second embodiment of the present invention taken along a longitudinal direction of the channel 8. The second embodiment is different from the first embodiment in that the actuator portion 2 remains at the bottom surface of the groove 18 forming the channel 8, and the channel 8 is communicated with the nozzle 14 via a through hole 20 formed in the remaining actuator portion 2. Other configurations are the same as those in the first embodiment. The same parts or parts having the same functions are denoted by the same reference symbols.

The actuator portion 2 is ground so that the actuator portion 2 remains at the bottom portion of the groove 18. Then, the remaining actuator portion 2 is thinned by grinding from a rear surface side thereof, and the through hole 20 communicated with the channel 8 is formed by sandblasting and the like. As described above, by leaving the actuator portion 2 at the bottom portion of the groove 18, the wall 19 becomes stable when the first and second liquid chambers 12 and 13 are formed, which facilitates the manufacturing. Other points are similar to those in the first embodiment, and hence description thereof is omitted.

Third Embodiment

Figure 3:
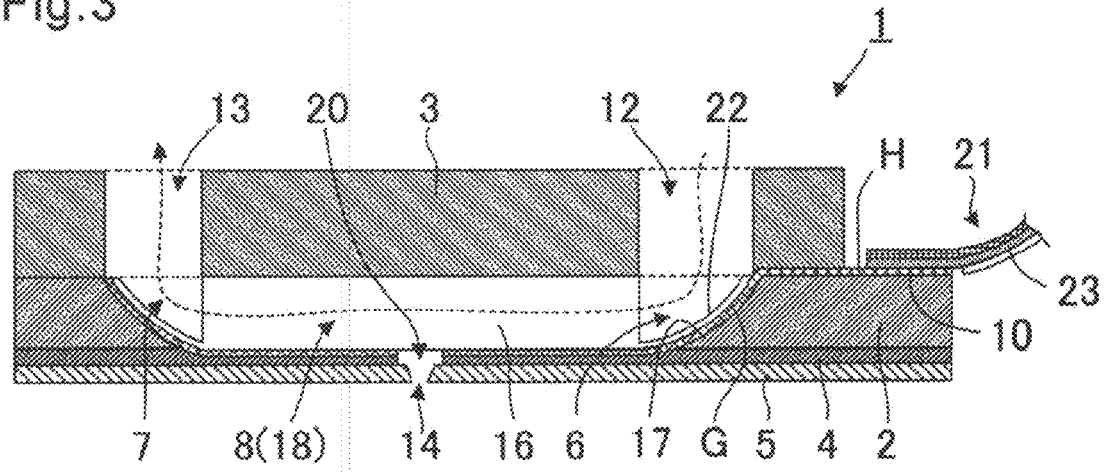
FIG. 3 is a schematic vertical sectional view of a liquid jet head according to a third embodiment of the present invention taken along a longitudinal direction of a channel.
Figure 4:
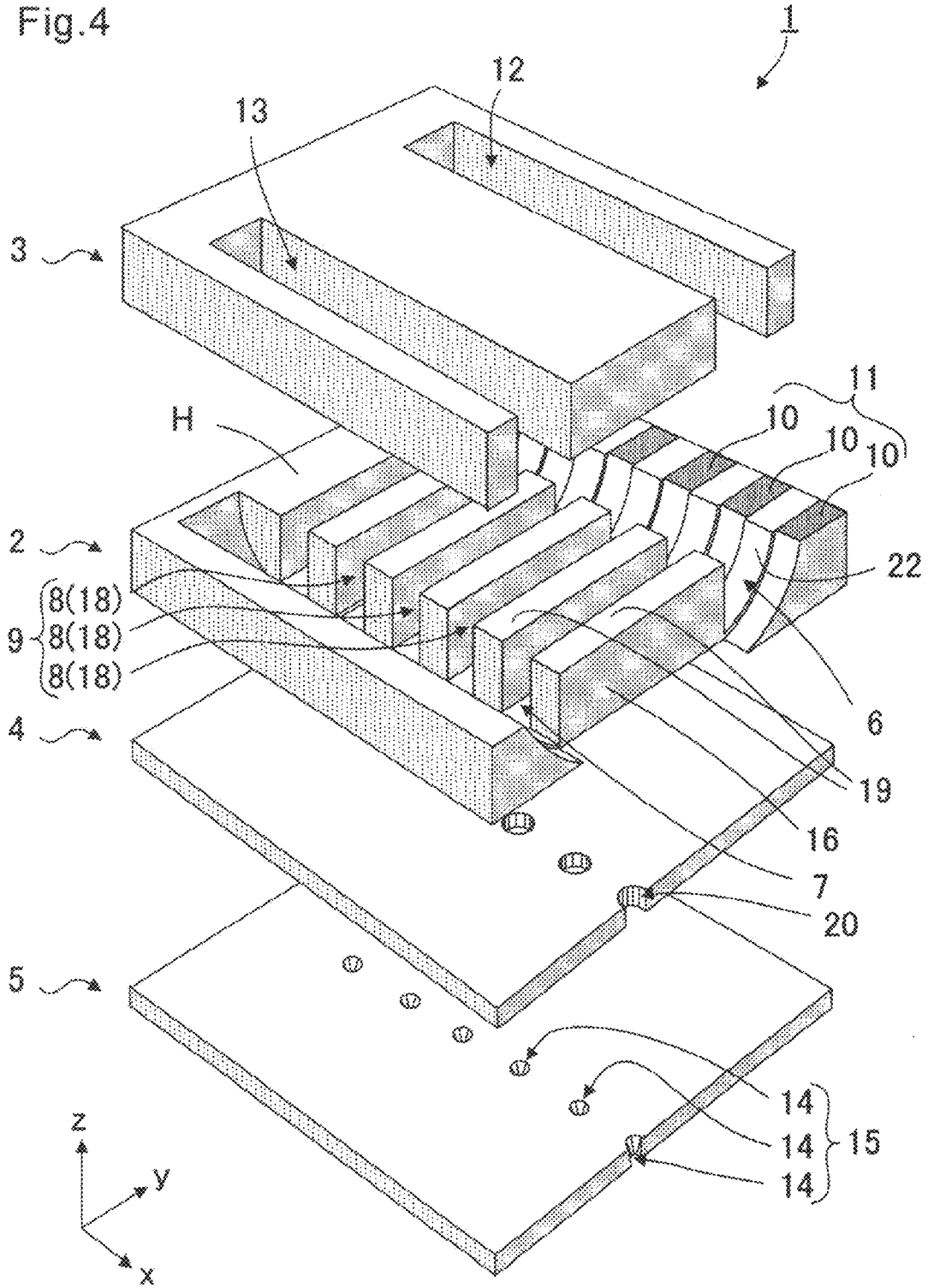
FIG. 4 is a schematic partial exploded perspective view of the liquid jet head according to the third embodiment of the present invention.
Figure 5:
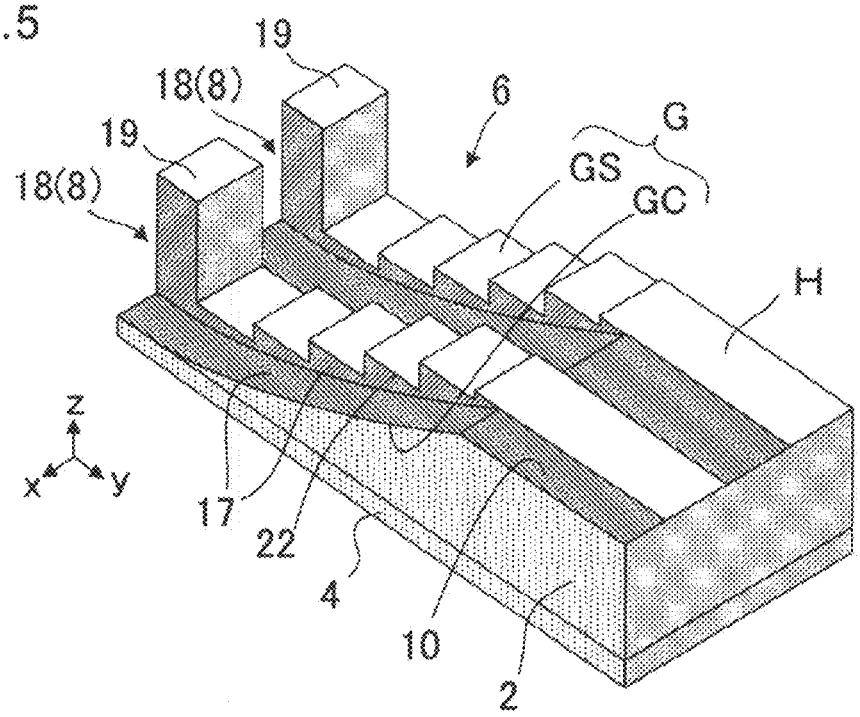
FIG. 5 is a schematic partial perspective view illustrating an example of a structure of a first recessed portion of the liquid jet head according to the third embodiment of the present invention.

FIGS. 3 to 5 are views for illustrating a liquid jet head 1 according to a third embodiment of the present invention. FIG. 3 is a schematic vertical sectional view of the liquid jet head 1 taken along a longitudinal direction of the channel 8, FIG. 4 is a schematic partial exploded perspective view of the liquid jet head 1, and FIG. 5 is a schematic partial perspective view illustrating an example of a structure of the first recessed portion 6.

As illustrated in FIGS. 3 and 4, the liquid jet head 1 includes the actuator portion 2 having the channels 8 for liquid droplet ejection formed therein, the cover plate 3 for closing openings on one side of the channels 8, and the nozzle plate 5 for liquid droplet ejection, which is bonded to the actuator portion 2 on a side opposite to the cover plate 3. The actuator portion 2 includes a base plate 4 on the nozzle plate 5 side. (In the following description, a part excluding the base plate 4 is referred to as the actuator portion 2, and the actuator portion 2 and the base plate 4 are described as separate members.)

The actuator portion 2 includes the first recessed portion 6, the second recessed portion 7 formed at a distance from the first recessed portion 6, a channel row 9, and the electrode terminal row 11. The channel row 9 is provided between the first recessed portion 6 and the second recessed portion 7, and includes the plurality of channels 8 arrayed therein and each having one end portion opened to the first recessed portion 6 and the other end portion opened to the second recessed portion 7. The electrode terminal row 11 is provided on the front surface H on the outer peripheral side with respect to the first recessed portion 6, and includes the plurality of electrode terminals 10 for transmitting the drive signal to the channel row 9.

The actuator portion 2 may be made with use of a piezoelectric material subjected to polarization processing. Examples of the piezoelectric material to be used include lead zirconate titanate (PZT) ceramics. The actuator portion 2 may have a laminated structure in which a piezoelectric material polarized in an upward direction with respect to the front surface H (+z direction) and a piezoelectric material polarized in a downward direction with respect to the front surface H (−z direction) are laminated. The channel 8 is formed of the groove 18 which is sandwiched by the two walls 19 extending from the first recessed portion 6 to the second recessed portion 7. The channel row 9 is formed of an array of the plurality of grooves 18 defined by the plurality of walls 19. The drive electrode 16 is provided on the side surface of each of the walls 19 forming the channels 8. The first recessed portion 6 and the second recessed portion 7 are each formed of the region obtained by removing the plurality of walls 19 while leaving the protrusions 22 unremoved, which are parts of the plurality of walls 19. Therefore, the side surface of the protrusion 22 and the side surface of the wall 19 are continuous with each other. Further, each of the channels 8 is opened to the first recessed portion 6 and the second recessed portion 7.

It is noted that the groove 18 may be formed to have such a depth that the actuator portion 2 remains at the bottom surface, or to have such a depth that reaches the base plate 4. When the base plate 4 is made with use of a low-dielectric constant material having a dielectric constant smaller than that of the piezoelectric material, it is preferred that the groove 18 be formed to have a depth that reaches the base plate 4. When the high-dielectric constant piezoelectric material is removed from a part between the two walls 19 forming the groove 18, a cross talk in which the drive signal leaks to the adjacent channel can be reduced.

The cover plate 3 includes the first liquid chamber 12 communicated with the first recessed portion 6 and the second liquid chamber 13 communicated with the second recessed portion 7. The cover plate 3 is bonded to the front surface H of the actuator portion 2 while exposing the electrode terminal row 11 and covering the channel row 9. It is preferred that the cover plate 3 have a coefficient of thermal expansion which is nearly equal to that of the actuator portion 2. For example, the cover plate 3 may be made with use of the same piezoelectric material as the actuator portion 2. The base plate 4 includes the plurality of through holes 20 communicated with the respective channels 8, and is bonded to the actuator portion 2 on a side opposite to the cover plate 3.

As a material for the base plate 4, there may be used ceramics such as machinable ceramics, PZT ceramics, silicon oxide, aluminum oxide (alumina), or aluminum nitride. Examples of the machinable ceramics include Macerite, Macor, Photoveel, and Shapal (which are all trademarks). In particular, the machinable ceramics can be easily ground, and has a coefficient of thermal expansion equivalent to that of the actuator portion 2. Therefore, the actuator portion 2 is not warped or cracked due to the temperature change, and thus the liquid jet head 1 with high reliability can be formed. In addition, when the machinable ceramics is used, because its dielectric constant is smaller than that of the piezoelectric material, a cross talk to be generated between the adjacent channels can be reduced.

The nozzle plate 5 includes a nozzle row 15 formed of the row of nozzles 14 communicated with the channels 8 via the through holes 20, and is bonded to the base plate 4. As the nozzle plate 5, a polyimide film may be used. On the front surface H of the actuator portion 2 on the outer peripheral end side, the flexible substrate 21 is provided. The wiring electrode 23 formed on the flexible substrate 21, and the electrode terminal 10 are electrically connected to each other via an anisotropic conductive member (not shown).

The electrode terminal 10 and the drive electrode 16 are electrically connected to each other via the wiring electrode 17 formed on the bottom surface G of the first recessed portion 6. That is, the bottom surface G of the first recessed portion 6 includes the protrusion 22 that is continuous with the wall 19 and that remains when the upper part of the wall 19 is removed. The wiring electrode 17 is formed on the side surface of the protrusion 22 and on the bottom surface G between the adjacent protrusions 22. Therefore, the drive signal applied to the electrode terminal is transmitted to the drive electrode 16 via the wiring electrode 17.

Specific description is made with reference to FIG. 5. The bottom surface G of the first recessed portion 6 includes an arc-like bottom surface GC continuous with the groove 18, and a step-like bottom surface GS which protrudes from the arc-like bottom surface GC and has an upper surface in a step shape. The wiring electrode 17 is formed of a conductive film formed on the arc-like bottom surface GC and a conductive film formed on the side surface of the protrusion 22. As described in detail later, the arc-like bottom surface GC is formed by using a disc-like dicing blade (also referred to as dicing saw or dicing wheel) when the groove 18 is formed. Further, the protrusion 22 having a step-like upper end portion is formed by grinding the wall 19 by the dicing blade having a width corresponding to the width of each step in a direction orthogonal to the groove 18. At this time, the wiring electrode 17 formed on the arc-like bottom surface GC is prevented from being cut. Grinding is performed so that an outer periphery of the dicing blade does not reach the arc-like bottom surface GC, and hence the protrusion 22 continuous with the wall 19 remains. It is noted that the protrusion 22 is also formed at the bottom surface of the second recessed portion 7, and the wiring electrode 17 is also formed on the bottom surface of the second recessed portion 7. However, the protrusion 22 and the wiring electrode 17 on the bottom surface of the second recessed portion 7 may be ground to be removed. Further, the bottom surface G of the second recessed portion 7 is not necessarily formed into an arc shape, and the arc-like bottom surface G may be removed when the second recessed portion 7 is formed.

The liquid jet head 1 is driven as follows. Liquid is supplied from the liquid tank (not shown) to the first liquid chamber 12 of the cover plate 3. Then, the liquid flows into the first recessed portion 6, and flows out from the first recessed portion 6 to fill each of the channels 8. Then, the liquid flows out from the second recessed portion 7 to the second liquid chamber 13, and returns to the liquid tank (not shown). Next, when the drive signal is applied from the control circuit (not shown) to the electrode terminal 10, the drive signal is transmitted to the drive electrode 16 on the side surface of the wall 19 forming the corresponding channel 8 via the wiring electrode 17. When an electric field is applied to the wall 19 based on the drive signal, the wall 19 deforms in the shearing mode, and the wall 19 is bent and deformed to change the volume of the channel 8. Thus, the liquid filled inside the channel 8 is ejected as a liquid droplet via the through hole 20 and the nozzle 14. The liquid jet head 1 performs the ejection operation by the three-cycle driving in which three channels are provided as one set and the respective channels are sequentially selected.

As described above, the electrode terminal row 11 is provided on the front surface H of the actuator portion 2 on the side opposite to the side on which the liquid droplets are ejected. Therefore, there is no need to provide limitation on height for connection to the outside circuit, and limitation on thickness of the flexible substrate 21 and other elements, which are provided on the electrode terminal row 11, is significantly alleviated. Further, as described in detail later, the electrode terminal 10 can be formed on the front surface H of the actuator portion 2 by collective patterning. Further, the liquid jet head 1 is a circulation-type liquid jet head in which liquid circulates. Therefore, by driving the actuator portion 2, generated heat is transmitted to the liquid, which enables efficient heat dissipation. Further, air bubbles and dust, which are mixed into the liquid, can be rapidly discharged to the outside. Thus, the liquid is not wasted, and it is also possible to suppress wasteful consumption of the recording medium due to recording failure.

It is noted that in the above-mentioned embodiment, a piezoelectric material which is subjected to polarization processing is used as the actuator portion 2, but instead, only the wall 19 forming the channel 8 may be made of a piezoelectric material, and the first recessed portion 6, the second recessed portion 7, and parts on the outer peripheral side with respect to the first recessed portion 6 and the second recessed portion 7 may be made of an insulating material having a dielectric constant smaller than that of the piezoelectric material. With this configuration, it is possible to reduce the usage amount of the expensive piezoelectric material and reduce the manufacturing cost. Further, the wiring electrode and the electrode terminal row are not formed on the piezoelectric material, and hence the capacitance between the electrodes is reduced, and thus power consumption is significantly reduced. It is noted that as the insulating material, a low-dielectric constant material such as machinable ceramics, alumina ceramics, and silicon dioxide may be used.

Fourth Embodiment

Figure 6:
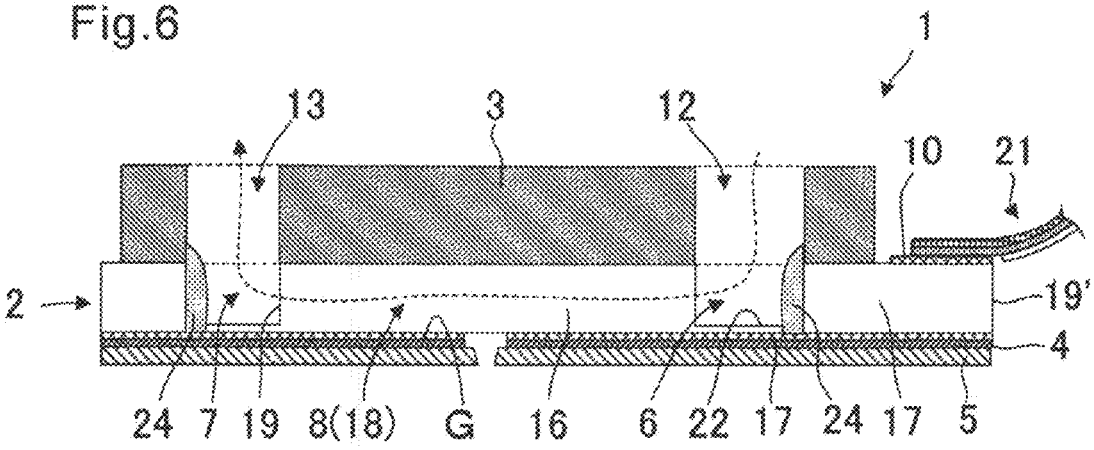
FIG. 6 is a schematic vertical sectional view of a liquid jet head according to a fourth embodiment of the present invention taken along a longitudinal direction of a channel.

FIG. 6 is a schematic vertical sectional view of a liquid jet head 1 according to a fourth embodiment of the present invention taken along the longitudinal direction of the channel 8. The fourth embodiment is different from the third embodiment in that the groove 18 forming the channel 8 is formed straightly to exceed the first recessed portion 6 and the second recessed portion 7 and reach the outer peripheral ends of the actuator portion 2. Other configurations are similar to those of the third embodiment. Therefore, in the following, parts different from the third embodiment are described.

The groove 18 forming the channel 8 of the actuator portion 2 is extended to exceed the first recessed portion 6 and the second recessed portion 7 and reach the outer peripheral ends of the actuator portion 2. The first recessed portion 6 and the second recessed portion 7 are formed by grinding the wall 19 to such a depth that the protrusion 22 remains. The bottom portion of each of the first recessed portion 6 and the second recessed portion 7 is formed of a flat surface having the same depth as the bottom surface of the groove 18 forming the channel 8, and the protrusion 22 continuous with the wall 19. The wiring electrode 17 is formed of a conductive film formed on the bottom surface of the groove 18, a conductive film continuous with this conductive film and formed on the bottom surface of the first recessed portion 6 and the side surface of the protrusion 22, and a conductive film continuous with the conductive film formed on the side surface of the protrusion 22 and formed on a side surface of a wall 19' on an outer peripheral side with respect to the first recessed portion 6.

On each of the first recessed portion 6 and the second recessed portion 7 on the outer peripheral side of the actuator portion 2, a sealing member 24 is provided, which prevents the liquid filled in the channel 8 from leaking to the outside. Note that, the position of the sealing member 24 is not limited to that illustrated in FIG. 6, and the sealing member 24 may be provided on the end portion side of the cover plate 3.

Also in this embodiment, the protrusion 22 continuous with the wall 19 remains at the bottom portion of each of the first recessed portion 6 and the second recessed portion 7. This reason is because, similarly to the case of the third embodiment, when the first recessed portion 6 and the second recessed portion 7 are formed, the outer periphery of the dicing blade grinds the walls 19 so as not to reach the bottom surface G, to thereby prevent cutting of the conductive film deposited on the bottom surface G. Note that, in FIG. 6, the protrusion 22 is formed at the bottom surface G of the second recessed portion 7, and the wiring electrode 17 is formed on the protrusion 22 and the bottom surface G between the protrusions 22. However, the conductive film on the protrusion 22 and the bottom surface G of the second recessed portion 7 may be ground to be removed.

The groove 18 forming the channel 8 is formed straightly to exceed the first recessed portion 6 and the second recessed portion 7 and reach the outer peripheral ends of the actuator portion 2, and hence the liquid jet head 1 can be downsized without being affected by the outer shape of the dicing blade. For example, when the dicing blade having a diameter of 2 inches is used to form the groove 18 having a depth of about 0.35 mm, the length of the arc-like bottom surface G in the direction of the groove 18 is about 8 mm, and about 12 mm is necessary when the diameter is 4 inches. In contrast, the groove 18 in this embodiment is formed straightly, and hence this length can be reduced to a fraction thereof. Further, in the case of the same size of the liquid jet head 1, the length of the channel 8 can be increased. Other points are similar to those of the third embodiment, and hence description thereof is omitted.

Fifth Embodiment

Figure 7:
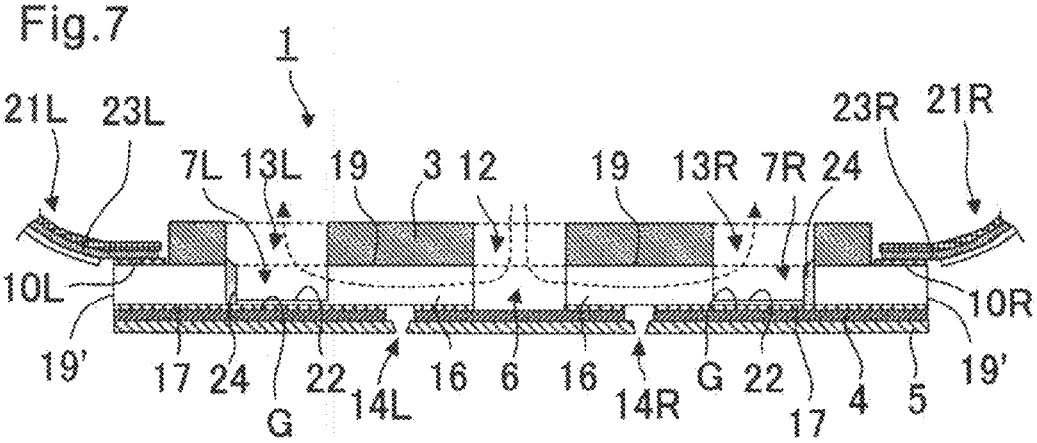
FIG. 7 is a schematic vertical sectional view of a liquid jet head according to a fifth embodiment of the present invention taken along a longitudinal direction of a channel.
Figure 8:
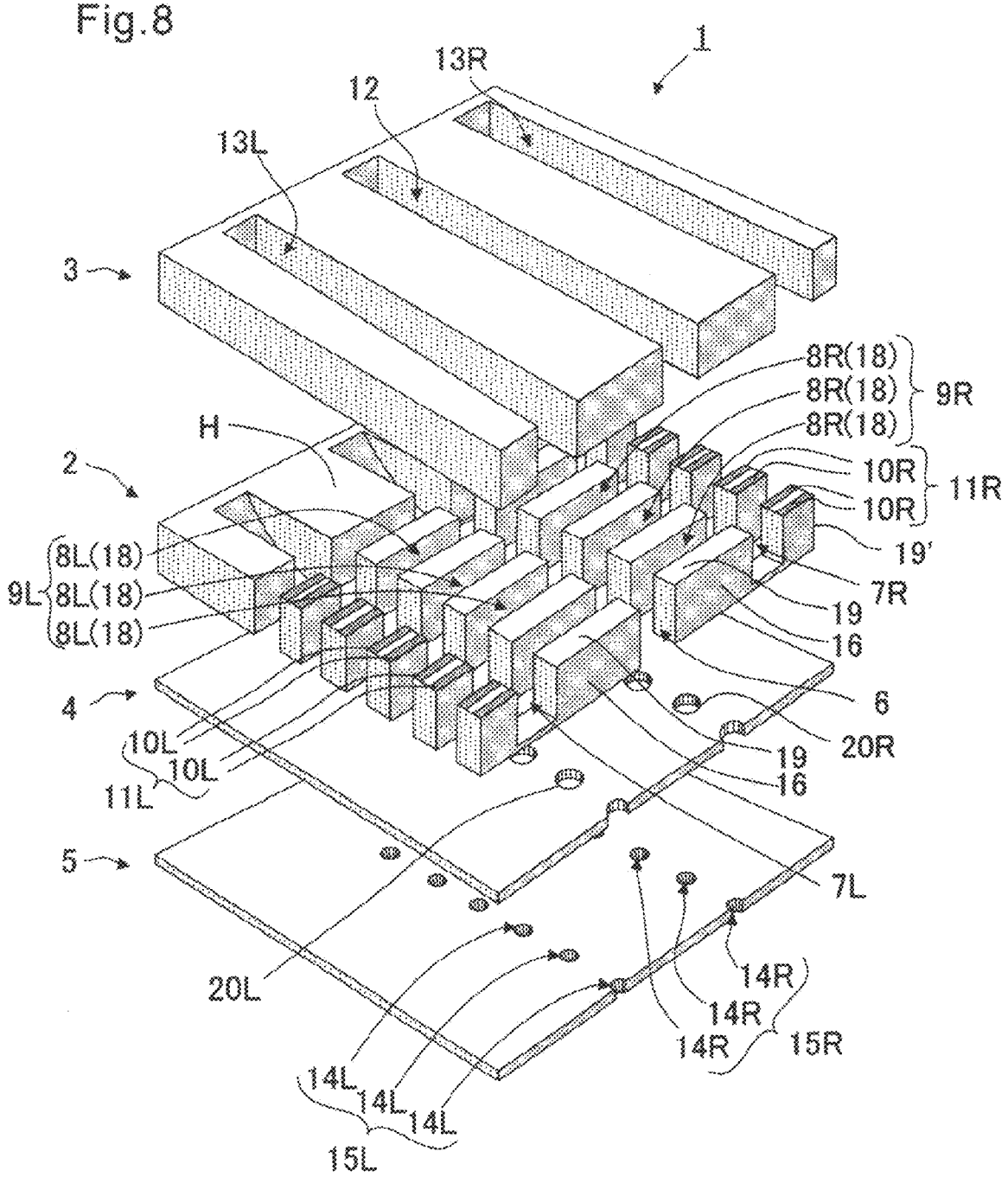
FIG. 8 is a schematic partial exploded perspective view of the liquid jet head according to the fifth embodiment of the present invention.

FIGS. 7 and 8 are views illustrating a liquid jet head 1 according to a fifth embodiment of the present invention. FIG. 7 is a schematic vertical sectional view of the liquid jet head 1 taken along the longitudinal direction of the channel 8, and FIG. 8 is a schematic partial exploded perspective view of the liquid jet head 1. The fifth embodiment is different from the fourth embodiment in that two channel rows are formed symmetrically, and two nozzle rows corresponding thereto are provided, thereby capable of doubling the recording density. The same parts or parts having the same functions are denoted by the same reference symbols.

As illustrated in FIGS. 7 and 8, the liquid jet head 1 includes the actuator portion 2 including left and right channels 8L and 8R for liquid droplet ejection, the cover plate 3 for closing the openings on one side of the left and right channels 8L and 8R, the base plate 4 bonded to the actuator portion 2 on the side opposite to the cover plate 3, and the nozzle plate 5 for liquid droplet ejection, which is bonded to the base plate 4.

The actuator portion 2 includes the first recessed portion 6, left and right second recessed portions 7L and 7R, a left channel row 9L, and a right channel row 9R. The left and right second recessed portions 7L and 7R are each formed at a distance from the first recessed portion 6, and are provided so that the first recessed portion 6 is interposed therebetween. The left channel row 9L is provided between the first recessed portion 6 and the left second recessed portion 7L, and includes the plurality of left channels 8L arrayed therein, the plurality of left channels 8L each having one end portion opened to the first recessed portion 6 and the other end portion opened to the left second recessed portion 7L. The right channel row 9R is provided between the first recessed portion 6 and the right second recessed portion 7R, and includes the plurality of right channels 8R arrayed therein, the plurality of right channels 8R each having one end portion opened to the first recessed portion 6 and the other end portion opened to the right second recessed portion 7R. The actuator portion 2 further includes a left electrode terminal row 11L and a right electrode terminal row 11R. The left electrode terminal row 11L is provided on the front surface H on the outer peripheral side with respect to the left second recessed portion 7L, and includes a plurality of left electrode terminals 10L for transmitting a drive signal to the left channel row 9L. The right electrode terminal row 11R is provided on the front surface H on the outer peripheral side with respect to the right second recessed portion 7R, and includes a plurality of right electrode terminals 10R for transmitting a drive signal to the right channel row 9R.

The actuator portion 2 may be made with use of a piezoelectric material subjected to polarization processing. The piezoelectric material and the polarization direction are the same as those in the third embodiment. The left channel 8L is formed of the groove 18 which is sandwiched by the two walls 19 extending from the first recessed portion 6 to the left second recessed portion 7L. The left channel row 9L is formed of an array of the plurality of grooves 18 which are defined by the plurality of walls 19. The right channel 8R is formed of the groove 18 which is sandwiched by the two walls 19 extending from the first recessed portion 6 to the right second recessed portion 7R. The right channel row 9R is formed of an array of the plurality of grooves 18 which are defined by the plurality of walls 19. Further, each of the grooves 18 forming the left and right channels 8L and 8R is extended up to the outer peripheral end sides of the actuator portion 2 with respect to the left and right second recessed portions 7L and 7R.

The drive electrode 16 is provided on the side surface of each of the walls 19 forming the left and right channels 8L and 8R. The left and right second recessed portions 7L and 7R are each formed of a region obtained by removing the plurality of walls 19 while leaving the protrusions 22 unremoved, which are parts of the plurality of walls 19. Therefore, the side surface of the protrusion 22, the side surface of the wall 19, and the side surface of the wall 19' on the outer peripheral end side of the actuator portion 2 are continuous with one another. In the first recessed portion 6, all of the plurality of walls 19 are removed, and thus no protrusion 22 remains at its bottom surface. Each of the left channels 8L of the left channel row 9L is opened to the first recessed portion 6 and the left second recessed portion 7L. Similarly, each of the right channels 8R of the right channel row 9R is opened to the first recessed portion 6 and the right second recessed portion 7R.

The cover plate 3 includes the first liquid chamber 12 communicated with the first recessed portion 6, a left second liquid chamber 13L communicated with the left second recessed portion 7L, and a right second liquid chamber 13R communicated with the right second recessed portion 7R. The cover plate 3 is bonded to the front surface H of the actuator portion 2 while exposing the left electrode terminal row 11L and the right electrode terminal row 11R and covering the left channel row 91, and the right channel row 9R. The material and the like for the cover plate 3 are the same as those in the third embodiment, and hence description thereof is omitted. The base plate 4 includes a plurality of through holes 20L communicated with the respective left channels 8L of the left channel row 9L, and a plurality of through holes 20R communicated with the respective right channels 8R of the right channel row 9R. The base plate 4 is bonded to the actuator portion 2 on the side opposite to the cover plate 3. The material and the like for the base plate 4 are the same as those in the third embodiment, and hence description thereof is omitted.

The nozzle plate 5 includes a left nozzle row 15L and a right nozzle row 15R. The left nozzle row 15L includes a plurality of left nozzles 14L communicated with the respective left channels 8L of the left channel row 9L via the through holes 20L. The right nozzle row 15R includes a plurality of right nozzles 14R communicated with the respective right channels 8R of the right channel row 9R via the through holes 20R. The nozzle plate 5 is bonded to the base plate 4. The material and the like for the nozzle plate 5 are the same as those in the third embodiment, and hence description thereof is omitted.

On the front surface H of the actuator portion 2 on the left outer peripheral end side, a left flexible substrate 21L is provided. Each wiring electrode 23L formed on the left flexible substrate 21L, and each left electrode terminal 10L are electrically connected to each other via an anisotropic conductive member (not shown). Similarly, on the front surface H of the actuator portion 2 on the right outer peripheral end side, a right flexible substrate 21R is provided. Each wiring electrode 23R formed on the right flexible substrate 21R, and each right electrode terminal 10R are electrically connected to each other via an anisotropic conductive member (not shown).

At the bottom surface G of each of the left and right second recessed portions 7L and 7R, the protrusion 22 continuous with the wall 19 and the wall 19' remains. This reason is because, similarly to the case of the fourth embodiment, when each of the left and right second recessed portions 7L and 7R is formed, the outer periphery of the dicing blade grinds the walls 19 so as not to reach the bottom surface G, to thereby prevent cutting of the conductive film deposited on the bottom surface G. The left electrode terminal 10L formed on the upper end surface of the wall 19' and the drive electrode 16 formed on the side surface of the wall 19 of the left channel 8L are electrically connected to each other via the wiring electrode 17 formed on the bottom surface G of the groove 18 of the left channel 8L, the wiring electrode 17 formed on the bottom surface G of the left second recessed portion 7L, which is continuous with the bottom surface G of the groove 18, and the side surface of the protrusion 22, and the wiring electrode 17 formed on the bottom surface of the groove formed by the wall 19' of the outer peripheral portion and the side surface of the wall 19'.

Further, similarly to the fourth embodiment, on each of the left and right second recessed portions 7L and 7R on the outer peripheral side of the actuator portion 2, the sealing member 24 is provided, which prevents the liquid filled in the left and right channels 8L and 8R and the left and right second recessed portions 7L and 7R from leaking to the outside. Note that, the position of the sealing member is not limited to that illustrated in FIG. 7, and the sealing member may be provided on the end portion side of the cover plate 3.

The liquid jet head 1 is operated as follows. Liquid is supplied from a liquid tank (not shown) to the first liquid chamber 12 of the cover plate 3. Then, the liquid flows into the first recessed portion 6, and flows out from the first recessed portion 6 to fill the respective channels 8 of the left and right channel rows 9L and 9R. Further, the liquid flows out from the left second recessed portion 7L and the right second recessed portion 7R to the left second liquid chamber 13L and the right second liquid chamber 13R, respectively, and returns to the liquid tank (not shown). Next, when the drive signal is applied from a control circuit (not shown) to the electrode terminals 10L and 10R of the respective left and right electrode terminal rows 11L and 11R, the drive signal is transmitted to the drive electrode 16 of the corresponding channel 8 via the wiring electrode 17. When an electric field is applied to the wall 19 based on the drive signal, the wall 19 deforms. Thus, liquid droplets are ejected from the corresponding respective nozzles 14L and 14R.

As described above, the channel structure and the liquid flow are symmetrical, and hence it is possible to match the ejection condition of the liquid droplet ejected from the left nozzle row 15L and the ejection condition of the liquid droplet ejected from the right nozzle row 15R. Further, the groove 18 forming the channel is formed straightly from one end to the other end of the actuator portion 2, and hence the liquid jet head 1 can be downsized without being affected by the outer shape of the dicing blade. Further, the left and right electrode terminal rows 11L and 11R are provided on the front surface H of the actuator portion 2 on a side opposite to the side on which the liquid droplets are ejected. Therefore, there is no need to provide limitation on height for connection to the outside circuit, and limitation on thickness of the flexible substrate 21 and other elements, which are provided on the left and right electrode terminal rows 11L and 11R, is significantly alleviated.

Sixth Embodiment

Figure 9:
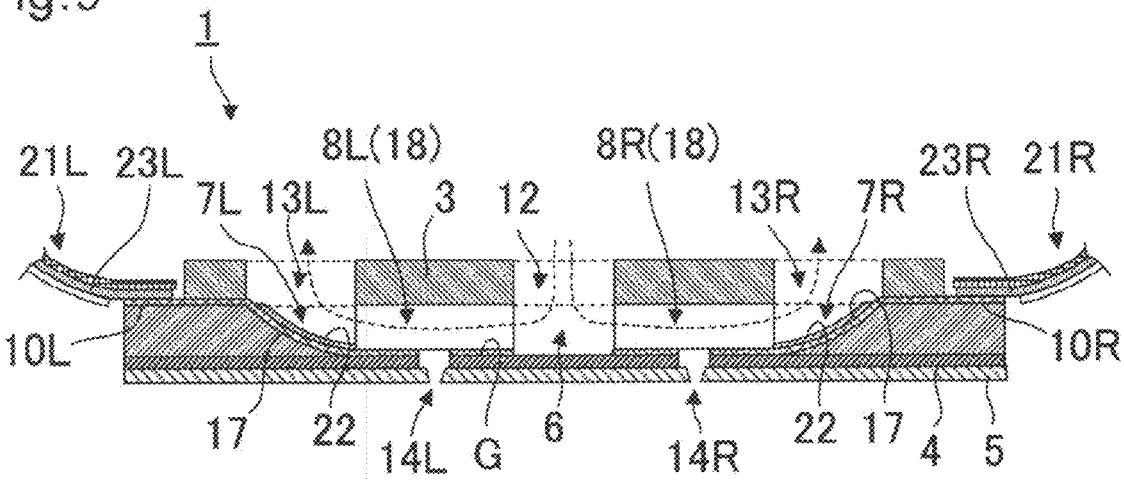
FIG. 9 is a schematic vertical sectional view of a liquid jet head according to a sixth embodiment of the present invention taken along a longitudinal direction of a channel.

FIG. 9 is a schematic vertical sectional, view of a liquid jet head 1 according to a sixth embodiment of the present invention taken along the longitudinal direction of the channel 8. The sixth embodiment is different from the fifth embodiment in that the bottom surface of each of the left and right second recessed portions 7L and 7R is formed into an arc shape. Other parts are similar to those in the fifth embodiment. Therefore, in the following, description is made of the different parts.

As illustrated in FIG. 9, the bottom portion of the left second recessed portion 7L includes an arc-like bottom surface continuous with the bottom surface G of the groove 18 of the left channel 8L, and the protrusion 22 protruding above the arc-like bottom surface. This arc shape is formed because the outer shape of the dicing blade is transferred when the left channel 8L is formed by the dicing blade. The bottom portion of the right channel 8R similarly has the arc shape. In the actual shape, as illustrated in FIG. 5, the arc-like bottom surface and the protrusion 22 protruding from the bottom surface are provided, and the upper end of the protrusion 22 is formed into a step shape. This reason is as described in the third embodiment.

The bottom portion of each of the left and right second recessed portions 7L and 7R has an inclination that becomes gradually shallower along the liquid flow. Therefore, liquid does not accumulate as compared to the case where the bottom portion has a rectangular shape. Thus, the flow is smooth. Therefore, cleaning of the inside of the liquid jet head and liquid replacement are facilitated. Further, the air bubbles mixed into the liquid are less likely to accumulate in the vicinity of the channel, and hence the ejection characteristics become stable.

Seventh Embodiment

Figure 10:
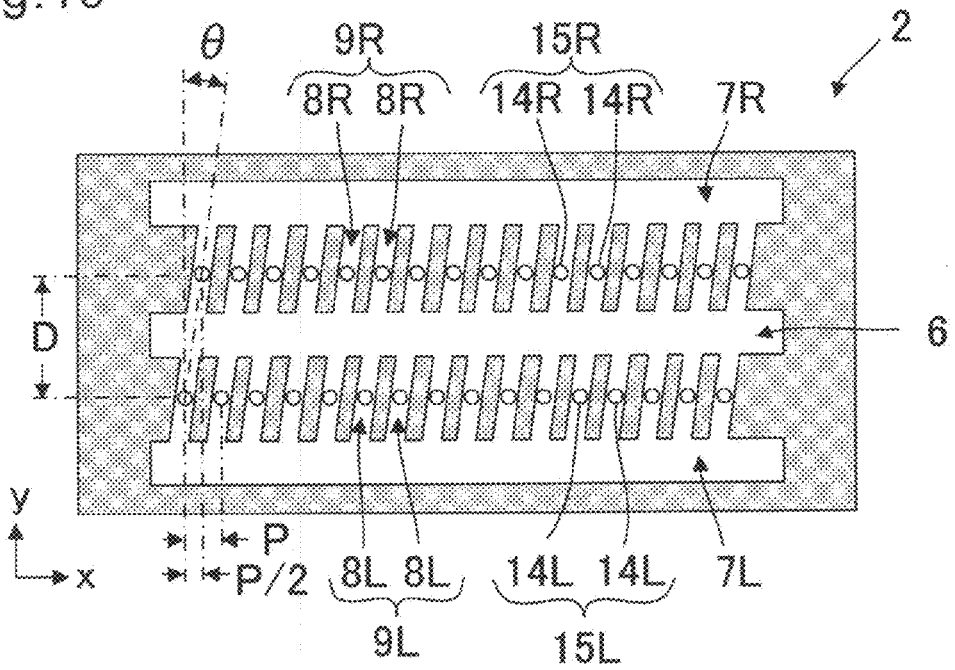
FIG. 10 is a schematic top view of an actuator portion of a liquid jet head according to a seventh embodiment of the present invention.

FIG. 10 is a schematic top view of the actuator portion 2 of a liquid jet head 1 according to a seventh embodiment of the present invention. The first recessed portion 6 is arranged to be interposed between the left second recessed portion 7L and the right second recessed portion 7R. The left channel row 9L is provided between the first recessed portion 6 and the left second recessed portion 7L, and includes the plurality of left channels 8L arrayed therein. The right channel row 9R is provided between the first recessed portion 6 and the right second recessed portion 7R, and includes the plurality of right channels 8R arrayed therein.

In this case, the left channel row 9L and the right channel row 9R are located at positions shifted by a half pitch (P/2) of a channel pitch P from each other in a row direction (x direction). As a result, the left nozzle row 15L and the right nozzle row 15R are shifted by a half pitch (P/2) of a nozzle pitch P from each other in the row direction, and when viewed from a y direction orthogonal to the row direction, the right nozzle 14R is located between the left nozzles 14L. When the y direction orthogonal to the row direction is defined as the scanning direction of the liquid jet head 1, the recording density can be doubled.

In this embodiment, the row direction in which the respective channels 8 are arrayed is defined as the x direction, the direction orthogonal thereto is defined as the y direction, and the longitudinal direction of each of the left and right channels 8L and 8R is inclined by an inclination angle θ with respect to the y direction so that the left channel 8L and the right channel 8R are arranged in one line. Further, the y direction may be defined as the scanning direction of the liquid jet head 1.

Note that, in this embodiment, the right nozzle row 15R is shifted with respect to the left nozzle row 15L by a half pitch in the row direction, but the present invention is not limited thereto. Generally, the left nozzle row 15L and the right nozzle row 15R are only required to be shifted by (2n−1)P/2 (n is a positive integer, and P is the nozzle pitch) in the row direction. Note that, the inclination angle θ can be determined so as to satisfy the following expression:

$$\tan(\theta)=(2n-1)P/(2D),$$

where D represents a distance between the left channel 8L and the right channel 8R in the y direction.

Eighth Embodiment

Figure 11A:
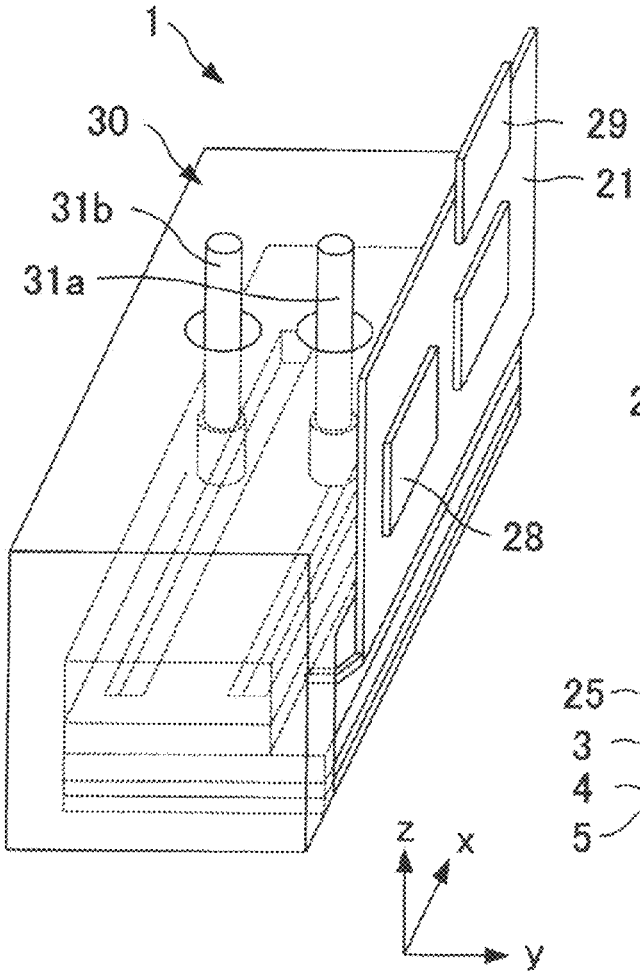
FIGS. 11A and 11B are schematic perspective views of a liquid jet head according to an eighth embodiment of the present invention.
Figure 11B:
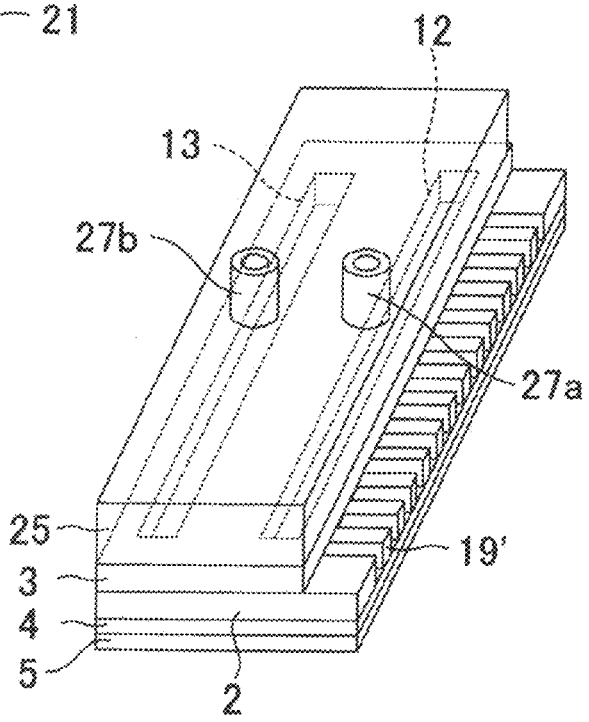

FIGS. 11A and 11B are schematic perspective views of a liquid jet head 1 according to an eighth embodiment of the present invention. FIG. 11A is a perspective view of the entire liquid jet head 1, and FIG. 11B is a perspective view of the inside of the liquid jet head 1.

As illustrated in FIGS. 11A and 11B, the liquid jet head 1 has a laminated structure of the nozzle plate 5, the base plate 4, the actuator portion 2 including the plurality of walls 19', the cover plate 3, and a flow path member 25. The laminated structure of the nozzle plate 5, the base plate 4, the actuator portion 2, and the cover plate 3 are the same as that in the fourth embodiment. The nozzle plate 5, the base plate 4, and the actuator portion 2 each have a y-direction width which is larger than a y-direction width of each of the cover plate 3 and the flow path member 25. The cover plate 3 is bonded on the upper surface of the actuator portion 2 so that the walls 19' are exposed. The plurality of walls 19' are arrayed in parallel in the x direction, and the electrode terminals 10 (not shown) are formed on the upper surfaces thereof. The cover plate 3 includes the first liquid chamber 12 communicated with the first recessed portion and the second liquid chamber 13 communicated with the second recessed portion.

The flow path member 25 includes a liquid supply chamber and a liquid discharge chamber (both not shown), which are formed of recessed portions opened in the surface on the cover plate 3 side, and includes a supply joint 27*a* communicated with the liquid supply chamber and a discharge joint 27*b* communicated with the liquid discharge chamber, which are formed on the surface of a side opposite to the cover plate 3.

The flexible substrate 21 is bonded onto the upper surfaces of the walls 19'. A large number of wiring electrodes (not shown) are formed on the flexible substrate 21, and are electrically connected to the electrode terminals 10 (not shown) formed on the upper surfaces of the walls 19'. The flexible substrate 21 includes, on its surface, a driver IC 28 as a drive circuit and a connector 29. The driver IC 28 generates a drive signal for driving the channel 8 (not shown) based on a signal input from the connector 29, and supplies the generated drive signal, to the drive electrode 16 (not shown) via the electrode terminal 10 (not shown).

A base 30 houses the laminate of the nozzle plate 5, the base plate 4, the actuator portion 2, the cover plate 3, and the flow path member 25. A liquid jetting surface of the nozzle plate 5 is exposed at a lower surface of the base 30. The flexible substrate 21 is pulled outside from a side surface of the base 30, and is fixed to an outer surface of the base 30. The base 30 includes two through holes in an upper surface thereof. A supply tube 31*a* for liquid supply is connected to the supply joint 27*a* while passing through one through hole, and a discharge tube 31*b* for liquid discharge is connected to the discharge joint 27*b* while passing through the other through hole.

The flow path member 25 is provided so as to supply liquid from an upper side and discharge the liquid to the upper side. Further, the driver IC 28 is mounted on the flexible substrate 21, and the flexible substrate 21 is bent to be provided upright in a z direction. The flexible substrate 21 is bonded to the upper surfaces of the walls 19' on the side opposite to the liquid ejection surface, and hence a space around the wiring can be sufficiently secured. Further, the driver IC 28 and the actuator portion 2 generate heat when being driven, but the heat is transferred to the liquid flowing inside via the base 30 and the flow path member 25. That is, with use of recording liquid for a recording medium as a cooling medium, the heat generated inside can be efficiently dissipated outside. Therefore, the driver IC 28 and the actuator portion 2 can be prevented from being lowered in driving ability due to overheating. Further, the liquid circulates inside the groove, and hence even when air bubbles are mixed, the air bubbles can be rapidly discharged to the outside. Thus, the liquid is not wasted, and it is also possible to suppress wasteful consumption of the recording medium due to recording failure. In this manner, it is possible to provide the liquid jet head 1 having high reliability.

Note that, in the above-mentioned third to eighth embodiments, description is made of embodiments in which the actuator portion 2 includes the base plate 4 on its nozzle plate side, but instead, as described in first and second embodiments, the base plate 4 may be omitted.

Liquid Jet Apparatus

Ninth Embodiment

Figure 12:
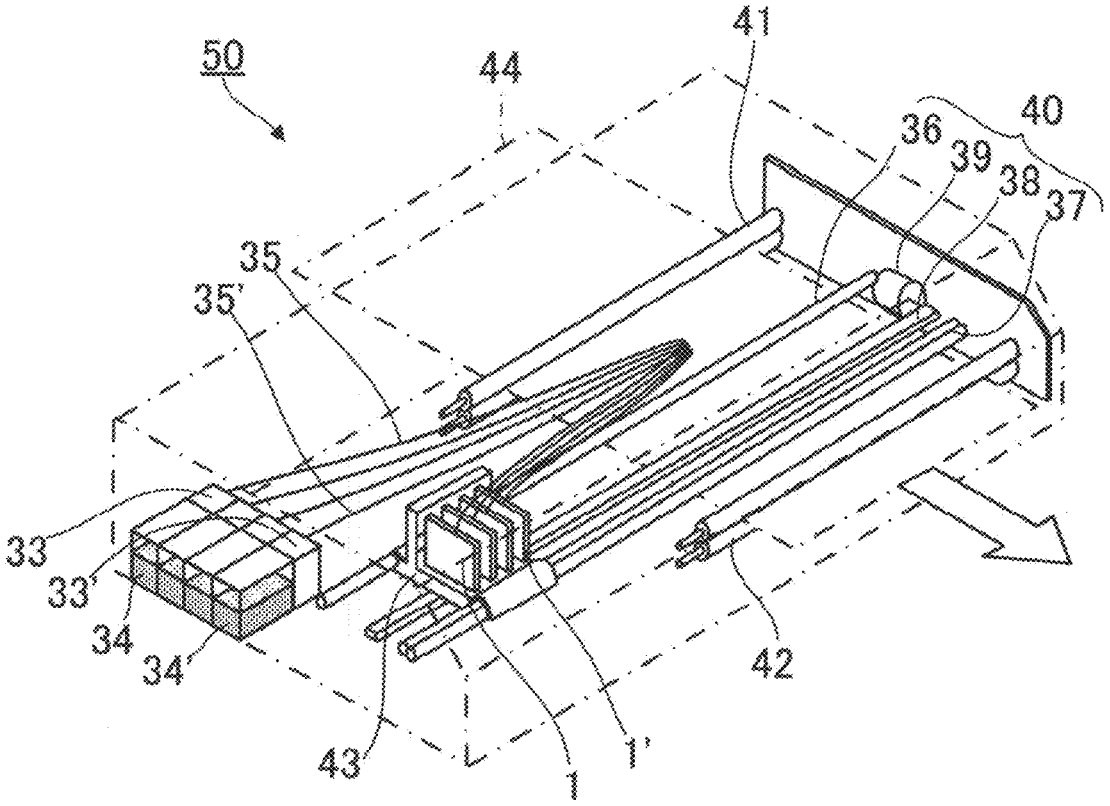
FIG. 12 is a schematic perspective view of a liquid jet apparatus according to a ninth embodiment of the present invention.

FIG. 12 is a schematic perspective view of a liquid jet apparatus 50 according to a ninth embodiment of the present invention. The liquid jet apparatus 50 includes a moving mechanism for reciprocating liquid jet heads 1 and 1', flow path portions 34 and 35' for supplying liquid to the liquid jet heads 1 and 1' and collecting the liquid from the liquid jet heads 1 and 1', and liquid pumps 33 and 33' and liquid tanks 34 and 34' for circulating liquid to the flow path portions 35 and 35' and the liquid jet heads 1 and 1'. Each of the liquid jet heads 1 and 1' includes a plurality of ejection grooves, and a liquid droplet is ejected through a nozzle which communicates with each of the ejection grooves. As the liquid jet heads 1 and 1', any ones of the liquid jet heads of the first to eighth embodiments described above are used.

The liquid jet apparatus 50 includes a pair of conveyance means 41 and 42 for conveying a recording medium 44 such as paper in a main scanning direction, the liquid jet heads 1 and 1' for ejecting liquid toward the recording medium 44, a carriage unit 43 for mounting thereon the liquid jet heads 1 and 1', the liquid pumps 33 and 33' for pressurizing liquid stored in the liquid tanks 34 and 34' into the flow path portions 35 and 35' for circulation, and the moving mechanism 40 for causing the liquid jet heads 1 and 1' to scan in a sub-scanning direction which is orthogonal to the main scanning direction. A control portion (not shown) controls and drives the liquid jet heads 1 and 1', the moving mechanism 40, and the conveyance means 41 and 42.

Each of the pair of conveyance means 41 and 42 includes a grid roller and a pinch roller which extend in the sub-scanning direction and which rotate with roller surfaces thereof being in contact with each other. A motor (not shown) axially rotates the grid rollers and the pinch rollers to convey in the main scanning direction the recording medium 44 sandwiched therebetween. The moving mechanism includes a pair of guide rails 36 and 37 which extend in the sub-scanning direction, the carriage unit 43 which is slidable along the pair of guide rails 36 and 37, an endless belt 38 which is coupled to the carriage unit 43 for moving the carriage unit 43 in the sub-scanning direction, and a motor 39 for rotating the endless belt 38 via a pulley (not shown).

The carriage unit 43 has the plurality of liquid jet heads 1 and 1' mounted thereon for ejecting, for example, four kinds of liquid droplets: yellow; magenta; cyan; and black. The liquid tanks 34 and 34' store liquid of corresponding colors, and circulate the liquid via the liquid pumps 33 and 33' and the flow path portions 35 and 35' to the liquid jet heads 1 and 1'. The respective liquid jet heads 1 and 1' eject liquid droplets of the respective colors in accordance with a drive signal. Through control of ejection timings of liquid from the liquid jet heads 1 and 1', rotation of the motor 39 for driving the carriage unit 43, and conveyance speed of the recording medium 44, an arbitrary pattern may be recorded on the recording medium 44.

Method of Manufacturing Liquid Jet Head

Tenth Embodiment

Figure 13:
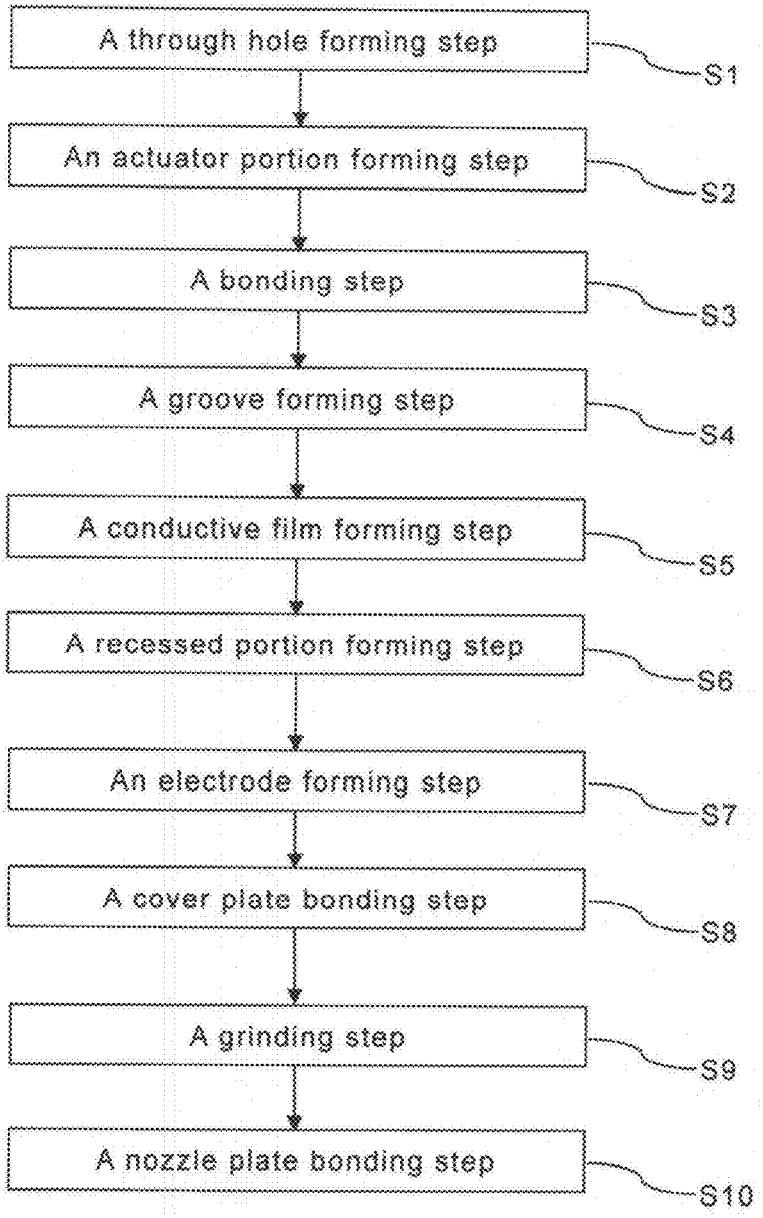
FIG. 13 is a process flow chart illustrating a basic method of manufacturing a liquid jet head according to a tenth embodiment of the present invention.

Next, a method of manufacturing a liquid jet head according to a tenth embodiment of the present invention is described. FIG. 13 is a process flow chart illustrating a basic method of manufacturing the liquid jet head 1 according to the present invention. FIGS. 14 to 17 are explanatory views illustrating respective steps.

Figure 14:
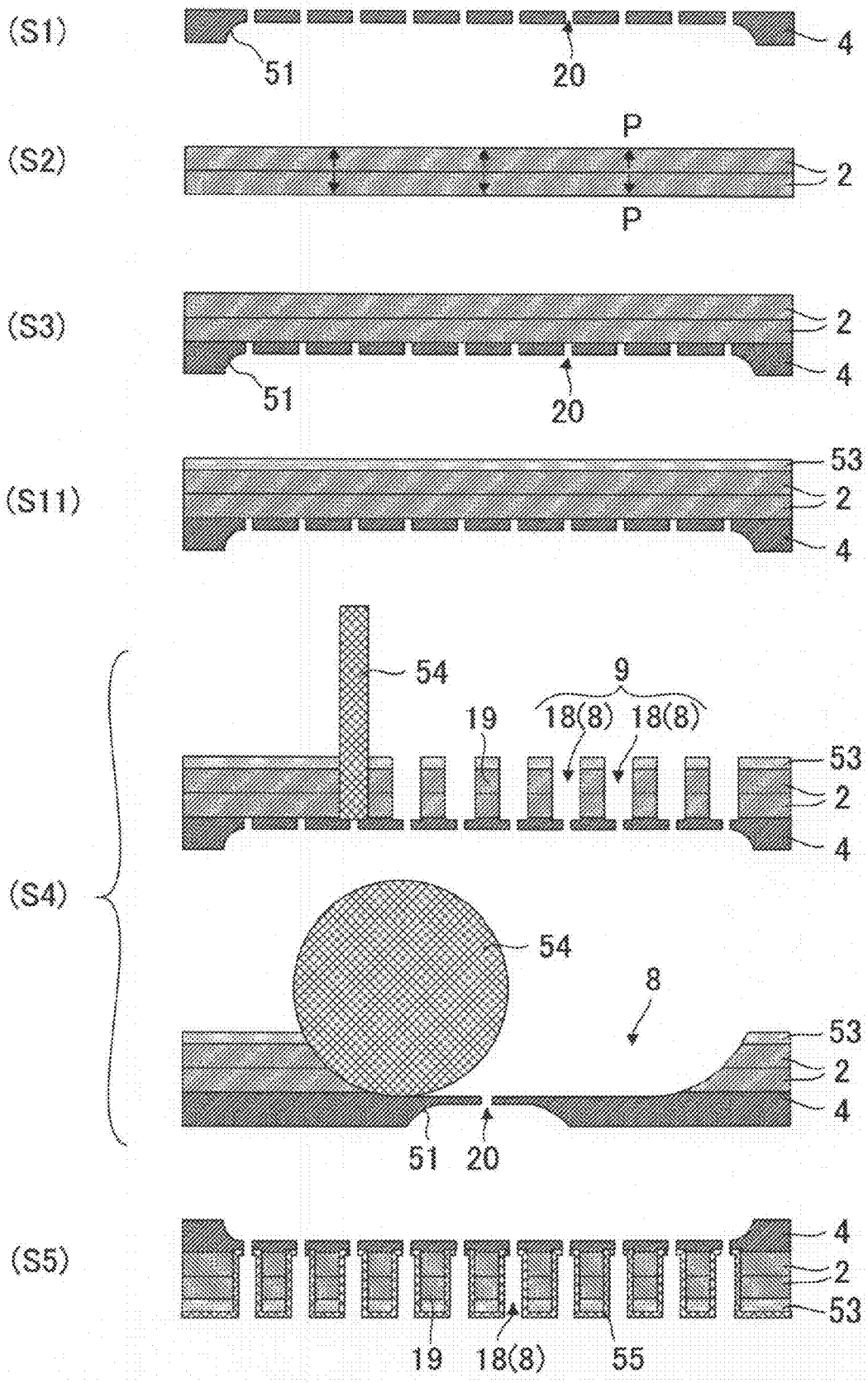
FIG. 14 is an explanatory view illustrating respective steps of the method of manufacturing a liquid jet head according to the tenth embodiment of the present invention.

First, in a through hole forming step S1, the through holes are formed in the base plate 4. A spot facing portion 51 is formed in one surface of the base plate 4, and the through holes 20 passing through the base plate 4 to reach the bottom surface of the spot facing portion 51 are formed from the other surface of the base plate 4. Part (S1) of FIG. 14 is a schematic sectional view of a region of the base plate 4 in which the through holes 20 are formed. The spot facing portion 51 is provided for facilitating the perforation of the through holes 20. When a ceramic plate is used as the base plate 4, it is extremely difficult to perform highly-accurate positioning and form, in the ceramic plate, a large number of thin holes each having a diameter of several tens to hundreds of micrometers and a depth of 200 μm or more. Therefore, the spot facing portion 51 is formed in advance as follows. For example, a ceramic plate having a thickness of about 0.2 mm to 1 mm is prepared, and the ceramic plate is subjected to sandblasting at a position corresponding to the through holes 20 so that the bottom thickness remains by 0.1 mm to 0.2 mm.

As the base plate 4, there may be used a material such as machinable ceramics, PZT ceramics, silicon oxide, aluminum oxide, or aluminum nitride. Examples of the machinable ceramics include Macerite, Macor, Photoveel, and Shapal (which are all trademarks). The through holes 20 are formed as many as the number of the nozzles at positions at which the nozzles are provided.

Next, in an actuator portion forming step S2, as illustrated in part (S2) of FIG. 14, the actuator portion 2 is formed by adhering together two piezoelectric materials subjected to processing of polarization P in directions opposite to each other, that is, an upward direction and a downward direction with respect to the plate surface. A PZT ceramics may be used as the piezoelectric material.

Next, in a bonding step S3, as illustrated in part (S3) of FIG. 14, the actuator portion 2 is bonded to the base plate 4 with an adhesive. An excess adhesive is pushed out from the through holes when the actuator portion 2 and the base plate 4 are adhered together, and hence the through holes 20 contribute to obtaining uniform thickness of the adhesive.

Next, in a photosensitive resin film providing step S11 (omitted in FIG. 13.), as illustrated in part (S11) of FIG. 14, a photosensitive resin film 53 is provided on the surface of the actuator portion 2 on a side opposite to the base plate 4 side. As the photosensitive resin film 53, a resist film is adhered, and next, by photolithography, exposure and development are performed to form a pattern of the resist film. The pattern of the resist film is a pattern for mainly forming the electrode terminal row, and the resist film is removed from the region in which the electrode terminal row is formed. As compared to a case where the pattern is formed by line drawing using laser light, a highly-accurate pattern can be formed in a short period of time. Note that, instead of adhering the resist film, resist liquid can be applied and dried as the resist film. Further, the photosensitive resin film providing step S11 is only required to be carried out after the bonding step S3 and before a conductive film forming step S5.

Next, in a groove forming step S4, as illustrated in part (S4) of FIG. 14, the plurality of grooves 18 and the walls 19 defining those grooves 18 are formed, which are arranged in parallel to each other on the surface of the actuator portion 2 on the side opposite to the base plate 4. Thus, the channel row 9 including the plurality of channels 8 formed of the grooves 18, which are arranged in parallel therein, is formed. An upper diagram of part (S4) of FIG. 14 is a schematic vertical sectional view in the direction of the channel row 9, and a lower diagram thereof is a schematic vertical sectional view in the longitudinal direction of the channel 8. A dicing blade 54 has a disc shape. Therefore, the outer shape of the dicing blade 54 is transferred to both end portions of the channel 8 (groove 18).

Grinding may be performed so that the material of the actuator portion 2 remains at the bottom portion of the groove 18, but it is preferred that grinding be performed so that the bottom portion of the groove 18 reaches the base plate 4. In a case where the base plate 4 is made of a material having a dielectric constant smaller than that of the piezoelectric material, when grinding is performed so that the high-dielectric constant piezoelectric material does not remain at the bottom portion of the groove 18, a cross talk between the adjacent channels can be reduced.

Note that, as in the fourth and fifth embodiments, in the case where the groove 18 is formed straightly from one end to the other end of the actuator portion 2, the outer shape of the dicing blade 54 is not transferred. Because the outer shape is not transferred, the length of the actuator portion 2 in the channel direction can be reduced to obtain a compact actuator portion.

Next, in the conductive film forming step S5, as illustrated in part (S5) of FIG. 14, a conductive material is deposited on the actuator portion 2, and a conductive film 55 is formed on the upper portions and the side surfaces of the plurality of walls 19 and the bottom surfaces of the grooves 18. The conductive film 55 is formed by depositing a metal such as aluminum, nickel, chromium, copper, gold, and silver by sputtering, vapor deposition, plating, or the like.

Figure 15A:
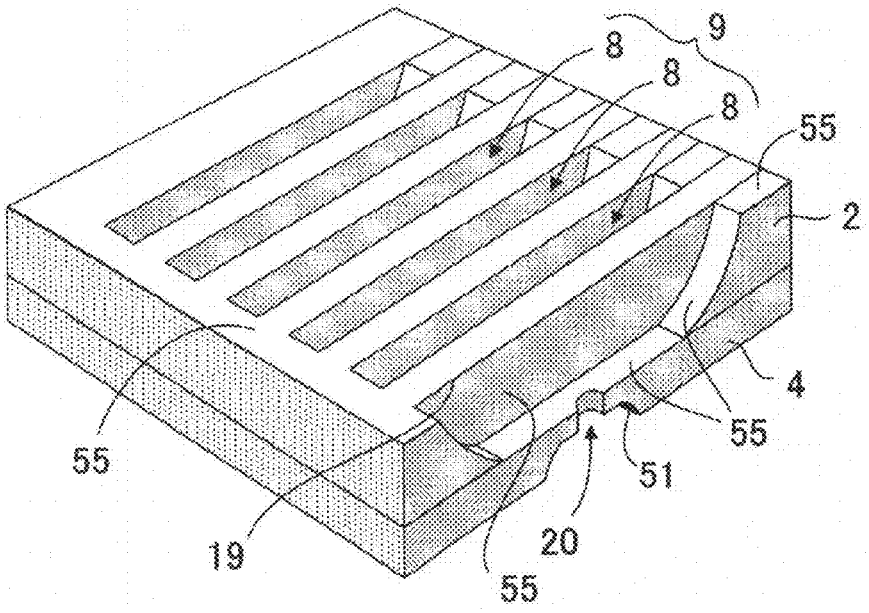
FIGS. 15A and 15B are explanatory views illustrating a step of the method of manufacturing a liquid jet head according to the tenth embodiment of the present invention.
Figure 15B:
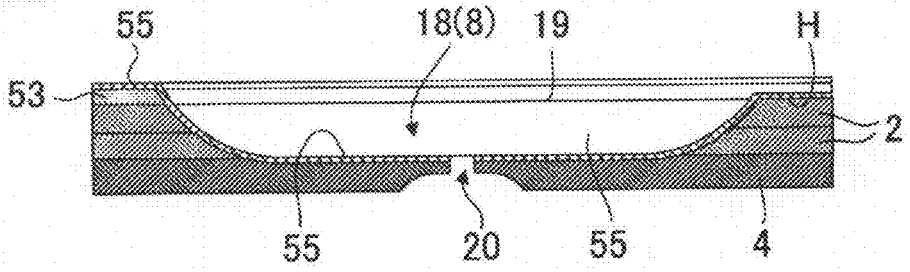

FIG. 15A is a schematic partial perspective view of the laminate including the actuator portion 2 and the base plate 4 after the conductive film forming step S5, and FIG. 15B is a schematic vertical sectional view in the longitudinal direction of the channel 8. In the actuator portion 2, the channel row 9 in which the channels 8 are arrayed is formed. The conductive film 55 is deposited on all of the upper surface of the actuator portion 2, the side surfaces of the walls 19, and the bottom surfaces of the grooves 18. In the front surface H in a region at one end portion of the actuator portion 2, in which the electrode terminals are formed, the photosensitive resin film 53 is removed. The conductive film 55 in this region is deposited continuously with the conductive film 55 of the arc-like bottom surface of the groove 18 and the flat bottom surface of the groove 18. Note that, in the region of the base plate 4 on the side opposite to the actuator portion 2, in which the through holes 20 are formed, the spot facing portion 51 is formed.

Figure 16:
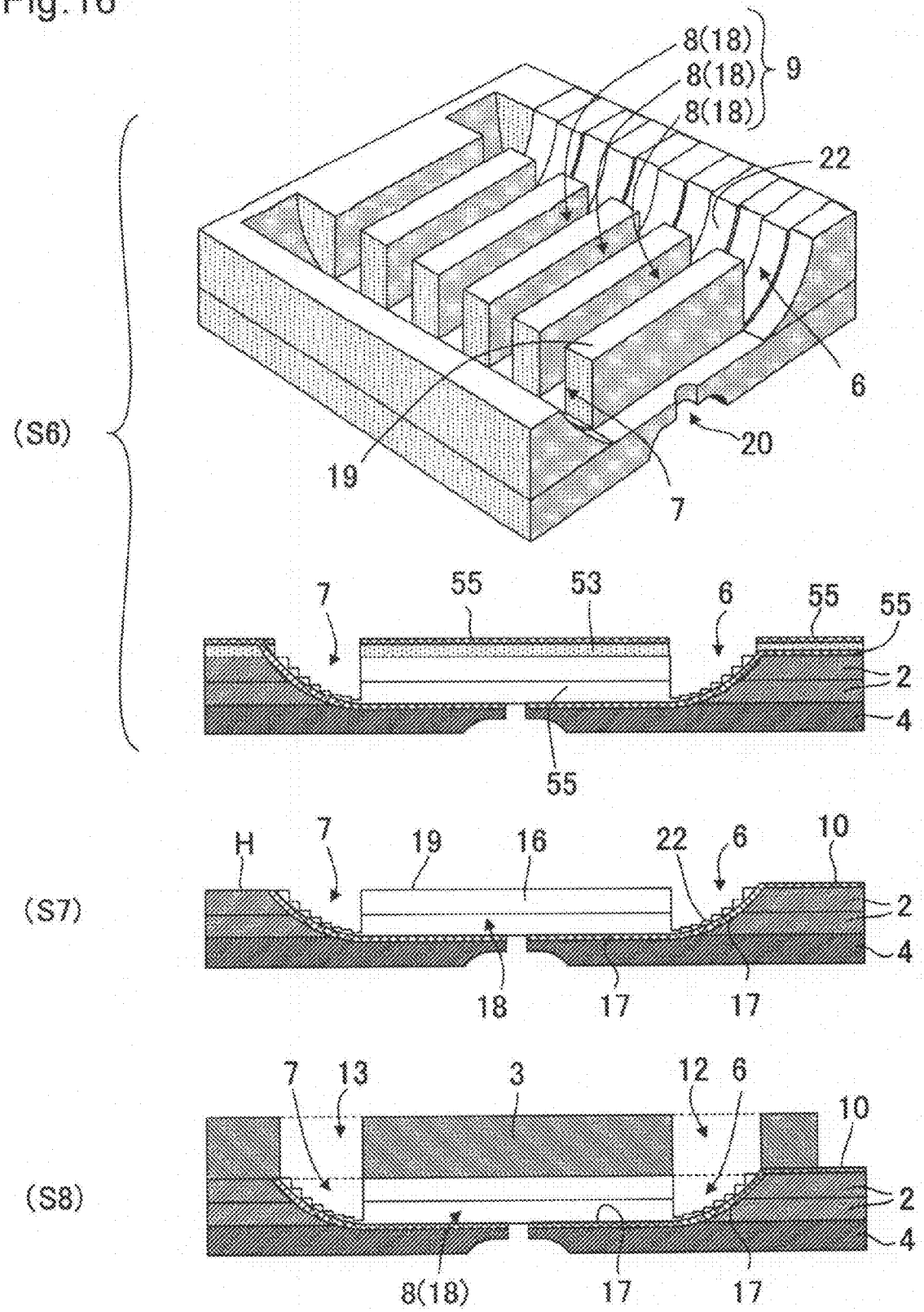
FIG. 16 is an explanatory view illustrating respective steps of the method of manufacturing a liquid jet head according to the tenth embodiment of the present invention.

Next, in a recessed portion forming step S6, the plurality of walls 19 are ground in a direction orthogonal to the longitudinal direction of the groove 18, thereby forming the first recessed portion 6 and the second recessed portion 7 which are distanced from each other via the channel row 9 and communicate to the plurality of grooves 18. An upper diagram of part (S6) of FIG. 16 is a schematic partial perspective view of the laminate including the actuator portion 2 and the base plate 4 after the first recessed portion 6 and the second recessed portion 7 are formed, and a lower diagram thereof is a schematic vertical sectional view in the longitudinal direction of the channel 8. As illustrated in part (S6) of FIG. 16, the dicing blade is used to scan and grind the walls 19 in the direction orthogonal to the longitudinal direction of the channel 8. At the time of grinding, in order to prevent cutting of the conductive film 55 deposited on the arc-like bottom surface, the wall 19 is ground in a manner that the outer periphery of the dicing blade does not reach the arc-like bottom surface. Therefore, the protrusions 22 protruding from the arc-like bottom surface are formed on the bottom surfaces of the first recessed portion 6 and the second recessed portion 7.

The wall 19 is ground with use of a dicing blade having a thickness smaller than the width of the first recessed portion 6 or the second recessed portion 7 in the channel direction, and hence the upper surface of the protrusion 22 has a step shape. Note that, instead of using the dicing blade having a thickness smaller than the width of the first recessed portion 6 or the second recessed portion 7 in the channel direction, by using a cylindrical grinding machine with an outer diameter having the arc shape of the groove 18, the upper surface of the protrusion 22 can be formed into an arc shape. Further, the bottom surface of the second recessed portion 7 is not necessarily formed into the arc shape, and may be formed into a rectangular shape similarly to the case of the fourth embodiment so that the conductive film 55 is removed from the bottom surface.

Next, in an electrode forming step S7, as illustrated in part (S7) of FIG. 16, the conductive film 55 is patterned to form the drive electrode 16 on the side surface of the wall 19, and form the electrode terminal 10 on the front surface H of the actuator portion 2. Through removal of the photosensitive resin film 53, the conductive film 55 is patterned (called lift off method). In other words, the photosensitive resin film 53 is removed, and thus the conductive film 55 deposited on the photosensitive resin film 53 is removed, thereby patterning the conductive film 55 on both side surfaces of the wall 19 and the conductive film 55 on the front surface H. As a result, the plurality of electrode terminals 10 electrically separated from each other are formed on the front surface H of the actuator portion 2, and the drive electrodes 16 electrically separated from each other are formed on both the side surfaces of the wall 19. The drive electrode 16 and the electrode terminal 10 are electrically connected to each other via the wiring electrode 17 formed on the arc-like bottom surface of the first recessed portion 6, the side surface of the protrusion 22, and the bottom surface of the groove 18.

Next, in a cover plate bonding step S8, as illustrated in part (S8) of FIG. 16, the cover plate 3 including the first liquid chamber 12 and the second liquid chamber 13 is bonded to the actuator portion 2 with an adhesive under a state in which the first liquid chamber 12 and the second liquid chamber 13 are communicated with the first recessed portion 6 and the second recessed portion 7, respectively, the electrode terminals 10 are exposed, and the upper openings of the plurality of grooves 18 are closed. It is preferred that the cover plate 3 be made with use of a material having a coefficient of thermal expansion which is nearly equal to that of the actuator portion 2. For example, when a PZT ceramics is used for the actuator portion 2, the cover plate 3 can be made using the same PZT ceramics. The cover plate 3 has a function of closing the upper end openings of the respective grooves 18 to form the channels 8 as well as a function of uniformly supplying liquid to the first recessed portion 6 and uniformly discharging the liquid from the second recessed portion 7.

Figure 17:
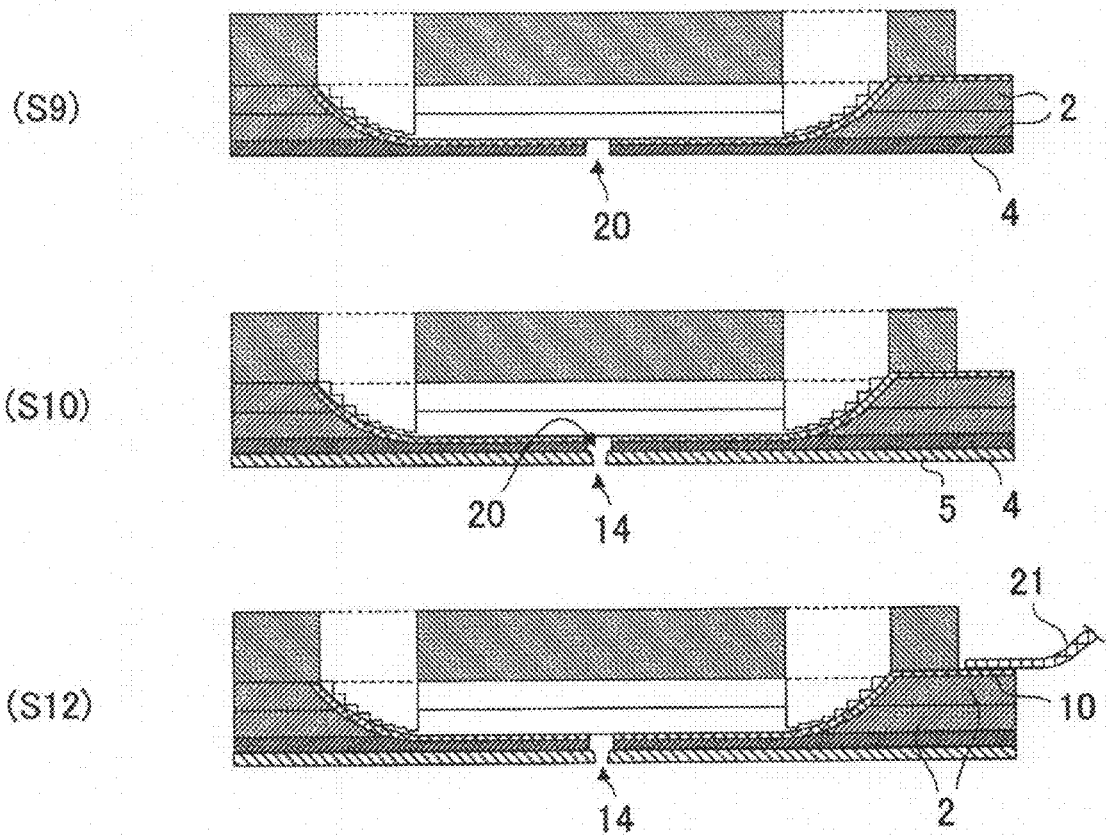
FIG. 17 is an explanatory view illustrating respective steps of the method of manufacturing a liquid jet head according to the tenth embodiment of the present invention.

Next, in a grinding step S9, the base plate 4 is ground on the side opposite to the actuator portion 2 so that the surface is planarized as illustrated in part (S9) of FIG. 17. Next, in a nozzle plate bonding step S10, as illustrated in part (S10) of FIG. 17, the nozzle plate 5 is bonded to the base plate 4 via an adhesive. The nozzle plate 5 is provided with the nozzles 14 communicated with the through holes 20. The nozzle 14 may be formed in advance before the nozzle plate 5 is bonded to the base plate 4, or may be formed at the positions of the through holes 20 after the bonding. The nozzle plate 5 may be formed with use of a polyimide film. The nozzle 14 may be perforated with use of laser light.

Next, in a flexible substrate bonding step S12 (omitted in FIG. 13), as illustrated in part (S12) of FIG. 17, the flexible substrate 21 is bonded to the front surface H of the actuator portion 2 so that the wiring electrode formed on the flexible substrate 21 and the electrode terminal 10 formed on the actuator portion 2 are electrically connected to each other via an anisotropic conductive member (not shown).

As described above, according to the method of manufacturing the liquid jet head 1 of the present invention, the electrode terminals 10 can be formed by collective patterning by photolithography, and hence this method is simpler as compared to the conventional method of performing pattering by line drawing using laser light, and manufacturing is possible in a short period of time. Further, unlike the conventional method, it is unnecessary to establish electrical connection between the inclined portion of the trapezoidal piezoelectric material and the flat portion to which this piezoelectric material adheres. Therefore, a highly-reliable wiring pattern can be formed. Further, in the conventional method, the frame member is provided after the electrode pattern is formed, and hence highly-accurate positioning has been necessary, but in present invention, positioning of the frame member is unnecessary. Further, in the conventional method, the surface planarizing step is necessary after the frame member is provided, but in the present invention, such a planarizing step is unnecessary, which leads to an advantage that the manufacturing is simplified.

Note that, in this embodiment, the method of manufacturing the liquid jet head 1 of the third embodiment is described, but it is apparent that this embodiment can be applied to manufacturing of the liquid jet heads 1 of the forth to sixth embodiments. In other words, as for the liquid jet head 1 of the fourth embodiment, in the groove forming step S4, grinding may be performed from one end portion to the other end portion of the actuator portion 2 straightly, and the sealing member 24 may be provided on the outer peripheral side of each of the first recessed portion 6 and the second recessed portion 7 so as to prevent leakage of liquid filled in the channel to the outside.

Further, as for the liquid jet head 1 of the fifth embodiment, in the through hole forming step S1, the through holes 20L and 20R are formed at respective positions corresponding to the left and right channel rows 9L and 9R, and in the recessed portion forming step S6, grinding is performed to reach the bottom surface of the groove 18 when the first recessed portion 6 is formed, and the upper portions of the walls 19 are ground so as to leave the bottom surfaces of the grooves 18 when the left and right second recessed portions 7L and 7R are ground. Specifically, the first recessed portion 6 is formed at a middle position of the left and right channel rows 9L and 9R, and the left and right second recessed portions 7L and 7R are formed on the left and right sides of the first recessed portion 6 at a distance from the first recessed portion 6. In the conductive film forming step S5, the left and right electrode terminal rows 11L and 11R are formed on the front surfaces H of both the end portions of the actuator portion 2. Further, in the cover plate bonding step S8, the cover plate 3, which includes the first liquid chamber 12 formed at a position corresponding to the first recessed portion 6 and the left and right second liquid chambers 13L and 13R formed at respective positions corresponding to the left and right second recessed portions 7L and 7R, is bonded to the actuator portion 2. In the nozzle plate bonding step S10, the nozzle plate 5, which includes the left and right nozzle rows 15L and 15R formed at positions corresponding to the left and right through holes 20L and 20R, is bonded to the base plate 4. Further, in the flexible substrate bonding step S12, the left and right flexible substrates 21L and 21R are bonded to the front surfaces H of the actuator portion 2 on which the left and right electrode terminal rows 11L and 11R are formed.

Eleventh Embodiment

Figure 18:
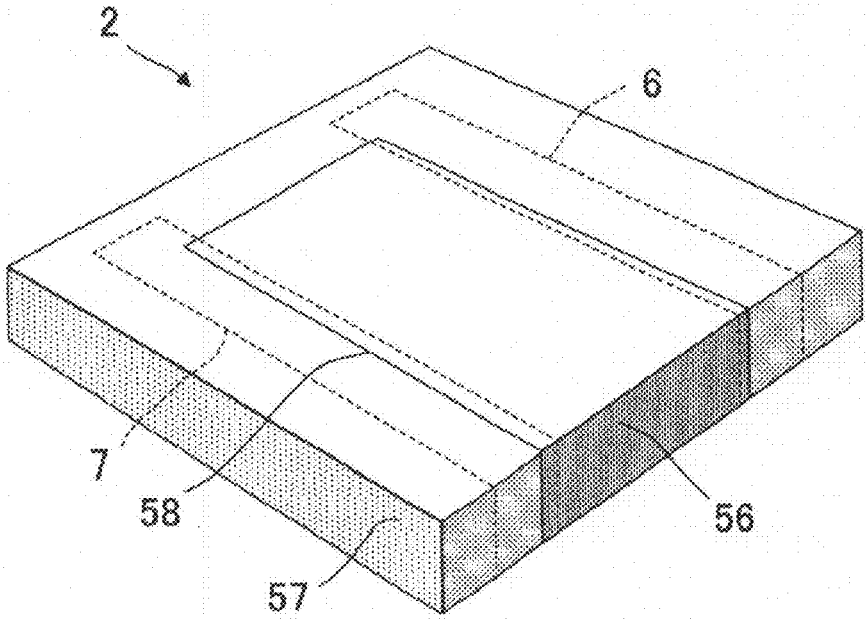
FIG. 18 is a schematic partial perspective view of an actuator substrate, for illustrating a method of manufacturing a liquid jet head according to an eleventh embodiment of the present invention.
Figure 19:
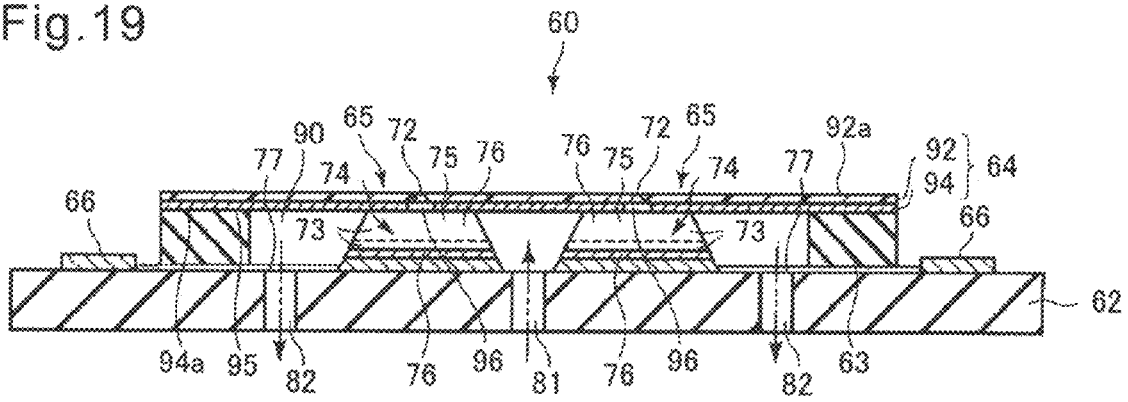
FIG. 19 is a sectional view of a conventionally-known ink jet head.

FIG. 18 is a schematic partial perspective view of the actuator portion 2, for illustrating a method of manufacturing a liquid jet head 1 according to an eleventh embodiment of the present invention. In the actuator portion forming step S2, the actuator portion 2 is formed as follows. A piezoelectric substrate 56 is fitted into an insulating substrate 57 made of an insulating material having a dielectric constant smaller than that of the piezoelectric material in a region that becomes the channel row, then planarizing is performed. In this case, the piezoelectric substrate 56 has a laminated structure in which a piezoelectric substrate upwardly-polarized with respect to the substrate surface and a piezoelectric substrate downwardly-polarized with respect thereto are laminated.

Further, in the recessed portion forming step S6, when the first recessed portion 6 and the second recessed portion 7 indicated by the broken lines are formed by grinding, a boundary plane 58 between the piezoelectric substrate 56 and the insulating substrate 57 is removed. In this manner, it is possible to reduce the usage amount of the expensive piezoelectric material and reduce the manufacturing cont. Further, the wiring electrode and the electrode terminal row are not formed on the piezoelectric substrate, and hence the capacitance between the electrodes is reduced, and thus the power consumption is significantly reduced. Note that, as the insulating substrate 57, a low-dielectric constant material such as machinable ceramics, alumina ceramics, and silicon dioxide may be used.

What is claimed is:

1. A liquid jet head, comprising:

an actuator portion comprising:

a first recessed portion;

a second recessed portion formed at a distance from the first recessed portion;

a channel row provided between the first recessed portion and the second recessed portion, the channel row including a plurality of channels each having one end portion opened to the first recessed portion and another end portion opened to the second recessed portion, the plurality of channels being formed of a plurality of grooves each sandwiched by two of a plurality of walls extending from the first recessed portion to the second recessed portion, each of the plurality of walls having a side surface made of a piezoelectric material and on which a drive electrode is provided;

an electrode terminal row provided on a front surface on an outer peripheral side with respect to one of the second recessed portion and the first recessed portion, the electrode terminal row including a plurality of electrode terminals for transmitting a drive signal to the channel row;

a cover plate including a first liquid chamber communicated with the first recessed portion and a second liquid chamber communicated with the second recessed portion, the cover plate being bonded to the actuator portion while exposing the electrode terminal row and covering the channel row; and a nozzle plate including a nozzle row which is formed of a row of nozzles communicated with the plurality of channels, the nozzle plate being bonded to the actuator portion on a side opposite to the cover plate, wherein wherein the plurality of electrode terminals are electrically connected to respective ones of the drive electrodes via respective wiring electrodes formed on a bottom portion of the one of the second recessed portion and the first recessed portion, and the one of the second recessed portion and the first recessed portion has a bottom surface including protrusions which are continuous with the walls and which remain when an upper part of the walls is removed, the wiring electrodes being formed on side surfaces of the protrusions and the bottom surface between adjacent protrusions.

2. A liquid jet head according to claim 1, wherein the second recessed portion comprises a right second recessed portion and a left second recessed portion which are provided so that the first recessed portion is interposed therebetween, wherein the channel row comprises:

a left channel row provided between the left second recessed portion and the first recessed portion; and a right channel row provided between the right second recessed portion and the first recessed portion, wherein the electrode terminal row comprises:

a left electrode terminal row for supplying the drive signal to the left channel row, the left electrode terminal row being provided on a front surface on an outer peripheral side with respect to the left second recessed portion; and a right electrode terminal row for supplying the drive signal to the right channel row, the right electrode terminal row being provided on a front surface on an outer peripheral side with respect to the right second recessed portion, and wherein the nozzle row comprises:

a left nozzle row communicated with channels in the left channel row; and a right nozzle row communicated with channels in the right channel row.

3. A liquid jet head according to claim 2, wherein the left nozzle row and the right nozzle row are shifted by ½ of a channel pitch from each other in a row direction.

4. A liquid jet head according to claim 1, wherein the plurality of grooves are extended to reach an outer peripheral end side of the actuator portion with respect to at least one of the second recessed portion and the first recessed portion.

5. A liquid jet head according to claim 1, further comprising a flexible substrate bonded to the front surface of the actuator portion on an end portion side and electrically connected to the electrode terminal row.

6. A liquid jet head according to claim 1, wherein the actuator portion has a laminated structure in which a piezoelectric material upwardly-polarized with respect to the front surface and a piezoelectric material downwardly-polarized with respect to the front surface are laminated.

7. A liquid jet head according to claim 1, wherein the actuator portion is made of a piezoelectric material in a part between the first recessed portion and the second recessed portion, including the side surfaces of the walls, and is made of an insulating material having a dielectric constant smaller than a dielectric constant of the piezoelectric material in a part on an outer peripheral side with respect to one of the second recessed portion and the first recessed portion.

8. A liquid jet head according to claim 1, wherein the plurality of channels are communicated with the nozzles via through holes, respectively.

9. A liquid jet head according to claim 8, wherein the actuator portion comprises a base plate, and wherein the through holes are formed in the base plate.

10. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

11. A liquid jet head according to claim 2, further comprising a flexible substrate bonded to the front surface of the actuator portion on an end portion side and electrically connected to the electrode terminal row.

12. A liquid jet head according to claim 2, wherein the actuator portion has a laminated structure in which a piezoelectric material upwardly-polarized with respect to the front surface and a piezoelectric material downwardly-polarized with respect to the front surface are laminated.

13. A liquid jet head according to claim 2, wherein the actuator portion is made of a piezoelectric material in a part between the first recessed portion and the second recessed portion, including the side surfaces of the walls, and is made of an insulating material having a dielectric constant smaller than a dielectric constant of the piezoelectric material in a part on an outer peripheral side with respect to one of the second recessed portion and the first recessed portion.

14. A liquid jet head according to claim 2, wherein the plurality of channels are communicated with the nozzles via through holes, respectively.

* * * * *